US005396025A

United States Patent [19]

Tamura

[11] Patent Number: 5,396,025

[45] Date of Patent: Mar. 7, 1995

[54] TONE CONTROLLER IN ELECTRONIC INSTRUMENT ADAPTED FOR STRINGS TONE

[75] Inventor: Motoichi Tamura, Hamamatsu, Japan

[73] Assignee: Yamaha Corporation, Japan

[21] Appl. No.: 988,171

[22] Filed: Dec. 9, 1992

[30] Foreign Application Priority Data

Dec. 11, 1991 [JP] Japan ..... 3-351060

[51] Int. Cl.[6] ..... G10H 1/12; G10H 3/14

[52] U.S. Cl. ..... 84/736; 84/DIG. 9

[58] Field of Search ..... 84/723–746, 84/DIG. 9

[56] References Cited

U.S. PATENT DOCUMENTS 5,117,730 6/1992 Yamauchi .
5,192,826 3/1993 Aoki ..... 84/743 X
5,247,131 9/1993 Okamoto et al. ..... 84/DIG. 9

FOREIGN PATENT DOCUMENTS

0264782A2 10/1987 European Pat. Off. .
3-206493 9/1991 Japan .

*Primary Examiner*—Stanley J. Witkowski
*Attorney, Agent, or Firm*—Graham & James

[57] ABSTRACT

A tone controller includes: a string counterpart member; a bow; a friction sound detector for detecting a friction sound generated by rubbing together the bow and the string counterpart member; and a signal processor for generating a tone control signal representing a bow pressure and a bow speed from an output of the friction sound detector.

18 Claims, 25 Drawing Sheets

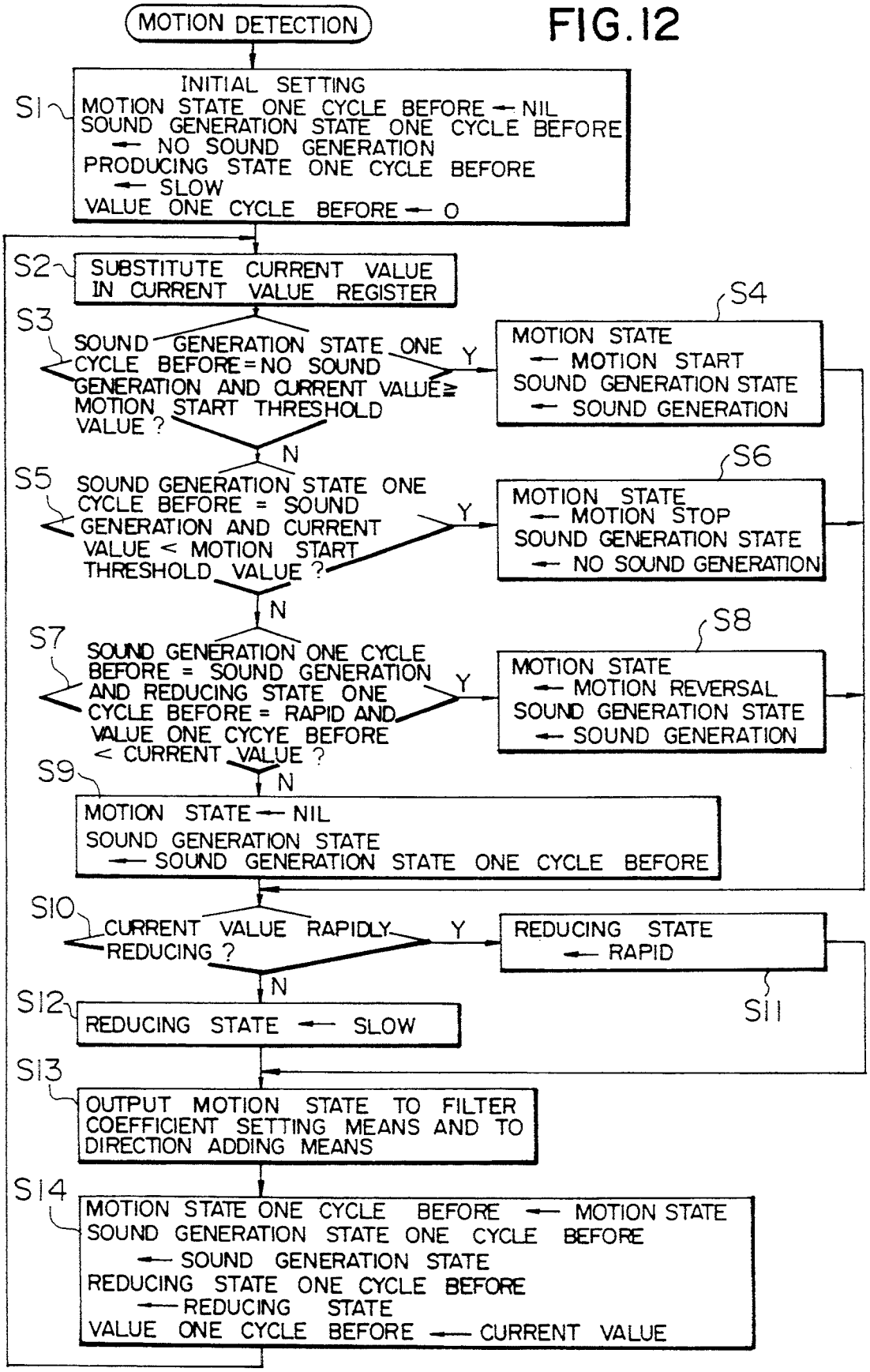
FIG. 12
MOTION DETECTION
S1
INITIAL SETTING
MOTION STATE ONE CYCLE BEFORE ← NIL
SOUND GENERATION STATE ONE CYCLE BEFORE ← NO SOUND GENERATION
PRODUCING STATE ONE CYCLE BEFORE ← SLOW
VALUE ONE CYCLE BEFORE ← 0
S2
SUBSTITUTE CURRENT VALUE IN CURRENT VALUE REGISTER
S3
SOUND GENERATION STATE ONE CYCLE BEFORE = NO SOUND GENERATION AND CURRENT VALUE ≧ MOTION START THRESHOLD VALUE ?
Y
S4
MOTION STATE ← MOTION START
SOUND GENERATION STATE ← SOUND GENERATION
N
S5
SOUND GENERATION STATE ONE CYCLE BEFORE = SOUND GENERATION AND CURRENT VALUE < MOTION START THRESHOLD VALUE ?
Y
S6
MOTION STATE ← MOTION STOP
SOUND GENERATION STATE ← NO SOUND GENERATION
N
S7
SOUND GENERATION ONE CYCLE BEFORE = SOUND GENERATION AND REDUCING STATE ONE CYCLE BEFORE = RAPID AND VALUE ONE CYCYE BEFORE < CURRENT VALUE ?
Y
S8
MOTION STATE ← MOTION REVERSAL
SOUND GENERATION STATE ← SOUND GENERATION
N
S9
MOTION STATE ← NIL
SOUND GENERATION STATE ← SOUND GENERATION STATE ONE CYCLE BEFORE
S10
CURRENT VALUE RAPIDLY REDUCING ?
Y
REDUCING STATE ← RAPID
S11
N
S12
REDUCING STATE ← SLOW
S13
OUTPUT MOTION STATE TO FILTER COEFFICIENT SETTING MEANS AND TO DIRECTION ADDING MEANS
S14
MOTION STATE ONE CYCLE BEFORE ← MOTION STATE
SOUND GENERATION STATE ONE CYCLE BEFORE ← SOUND GENERATION STATE
REDUCING STATE ONE CYCLE BEFORE ← REDUCING STATE
VALUE ONE CYCLE BEFORE ← CURRENT VALUE FIG. 17
| | BOW PRESSURE FILTER COEFFICIENT | BOW SPEED FILTER COEFFICIENT | EFFECTIVE PERIOD |
|---|---|---|---|
| MOTION START | 0.9 | 0.2 | 60 ms |
| IN MOTION | 0.1 | 0.02 | UNTIL NEXT MOTION |
| MOTION STOP | 0.6 | 0.2 | UNTIL MOTION START |
| MOTION REVERSAL | 0.4 | 0.2 | 60 ms |
FIG. 18A
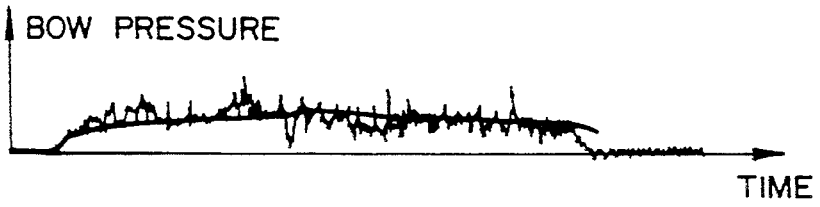
FIG. 18B
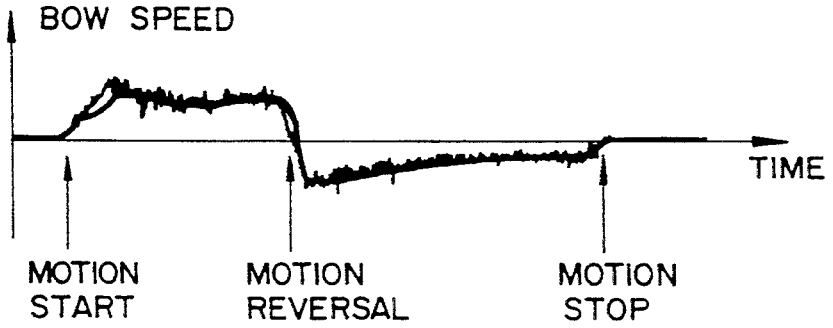

TONE CONTROLLER IN ELECTRONIC INSTRUMENT ADAPTED FOR STRINGS TONE

BACKGROUND OF THE INVENTION a) Field of the Invention

The present invention relates to a tone controller, and more particularly to a tone controller in an electronic musical instrument suitable for simulating a stringed instrument which gives a musical performance by drawing a movable playing member such as a bow across strings.

b) Description of the Related Art

As natural musical instruments for giving a performance with a bow, there are known a violin, viola, cello, contrabass, and the like. Miniatures of these instruments are also known.

Musical tones of a natural stringed instrument using a bow change in various ways depending upon musical tone Factors such as a bow speed, pressure, and the like.

Various techniques have been proposed for controlling musical tone factors such as a bow speed, pressure, and the like in producing a tone by using a stringed instrument using a bow of an electronic musical instrument.

For example, in an instrument disclosed in U.S. Pat. No. 5,117,730, a bow speed is detected by sensing with an optical sensor or the like a relative motion between a string counterpart member on an instrument body and a bow or movable playing member. A bow pressure is detected by a grip sensor mounted on a grip of the bow. The bow speed and pressure are used in generating a musical tone.

SUMMARY OF THE INVENTION

It is an object of the present invention to provide a tone controller for a stringed instrument using a bow, capable of providing performance techniques and sounds simulating a natural musical instrument as much as possible. According to one aspect of the present invention, there is provided a tone controller comprising: a string counterpart member; a bow; friction sound detecting means for detecting a friction sound generated by rubbing together the bow and the string counterpart member; and signal processing means for generating a tone control signal representing bow pressure and bow speed from an output off the friction sound detecting means.

According to another aspect of the present invention, there is provided a tone controller comprising: a string counterpart member; a bow; friction sound detecting means for detecting a friction sound generated by rubbing together the bow and the string counterpart member; and signal processing means for generating a tone control signal representing bow pressure and bow speed from an output of said friction sound detecting means.

The signal processing means may include, for example, a plurality of filters each having a different passband, wherein the tone control signal representing bow speed and bow pressure is generated by inputting the friction sound to the filters.

The signal processing means may include, for example, a plurality of filters whose pass-bands are alterable and means for setting the pass-band of each of the plurality of filters.

The friction sound detecting means can detect a friction sound generated by rubbing together material bodies.

The signal processing means includes, for example, means for detecting the direction of rubbing basing upon a change with time of an inputted friction sound, and adding a sign to the inputted friction sound in accordance with the detected direction.

According to a further aspect of the present invention, there is provided a tone controller comprising: a tone controller comprising: a string counterpart member; a bow; friction sound detecting means for detecting a friction sound generated by rubbing together the bow and the string counterpart member; strain detecting means for detecting a strain of the string counterpart member; and signal processing means for generating a bow speed tone control signal from an output of the friction sound detecting means, and generating a bow pressure tone control signal from an output of the strain detecting means.

It has been found, from the measurement results friction sounds generated by drawing a bow across a material body, that low-frequency components correspond to bow pressure and high frequency components correspond to bow speed. The present invention uses this fact to generate a tone control signal for bow speed (and bow pressure) in accordance with friction sounds.

According to the present invention, the use of a change in the frequency distribution of friction sounds generated by rubbing together a bow and a string counterpart member, allows the generation of a plurality of tone control signals at a time. Namely, the use off a single friction sound detecting means allows the generation of a plurality of tone control signals.

It is not necessary to manufacture a specific bow for use with the present invention, but rather bows presently available in the marketplace can be used.

Still further, according to the present invention, it is possible to generate a tone control signal for a bow speed from friction sounds between a bow and a string counterpart member, and to generate a tone control signal for bow pressure from a strain of the string counterpart member.

BRIEF DESCRIPTION OF THE DRAWINGS

FIG. 1A is a diagram for a middle bow pressure and a middle low speed, FIG. 1B is a diagram for a high bow pressure and a low bow speed, and FIG. 1C is a diagram for a low bow pressure and a high row speed.

FIG. 7A shows the intensity of a bow pressure signal, and FIG. 7B shows the intensity of a bow speed signal.

FIG. 8A shows an input signal, and FIG. 8B shows an output signal.

FIG.10A shows a bow speed input signal, and FIG. 10B shows the output signal.

FIG. 12 is a flow chart showing the operation of detecting a motion at the second processor shown in FIG. 11.

FIG. 16A illustrates the motion start, FIG. 16B illustrates the motion stop, and FIG. 16C illustrates the motion reversal.

FIG. 17 is a table following the characteristics of variable coefficient low-pass filters set; by the filter coefficient setting means of the second processor shown in FIG. 11.

FIGS. 18A and 18B show examples of the output signals from the variable coefficient low-pass filters whose coefficients set as shown in FIG. 17, FIG. 18A is a bow pressure output signal, and FIG. 18B is a bow speed output signal.

FIG. 19A shows an output signal when the filter coefficient of the variable coefficient low-pass filter is set small, and FIG. 19B shows an output signal when the filter coefficient of the variable coefficient low-pass filter is set large.

FIG. 21A illustrates the case where both the signals increase and decrease at the same time, and FIG. 21B illustrates the case of an actual stringed instrument using a bow.

FIG. 25A is the front view, FIG. 25B is the side view, and FIG. 25C is the rear view.

DETAILED DESCRIPTION OF THE PREFERRED EMBODIMENTS

In order to investigate the relationship between the bow speed and pressure and friction sounds generated by drawing a bow across a material body, the present inventor measured friction sounds generated by drawing a bow across styrene foam, by using an FAD analyzer. The measured results are shown in FIGS. 1A to 1C.

Figure 1A:
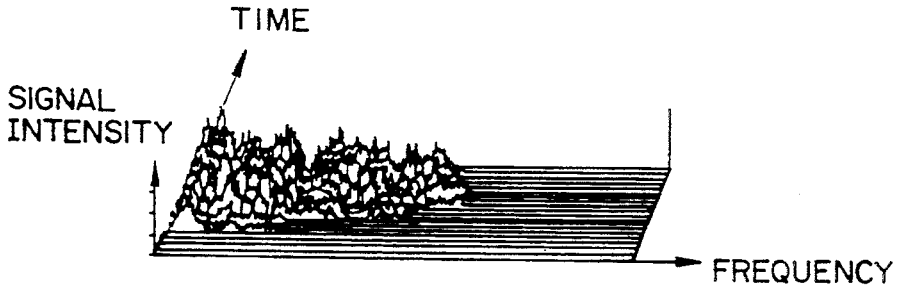
FIGS. 1A to 1C are diagrams showing the frequency distributions of friction sounds.
Figure 1B:
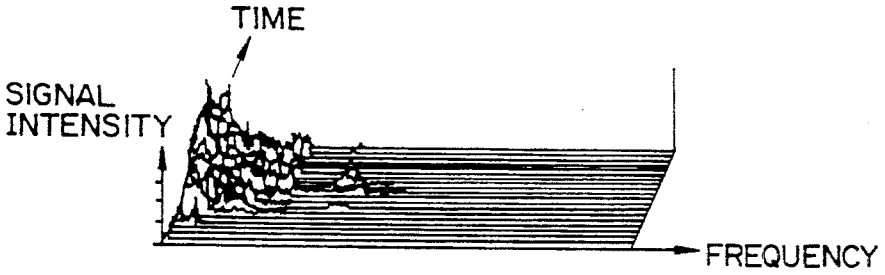
Figure 1C:
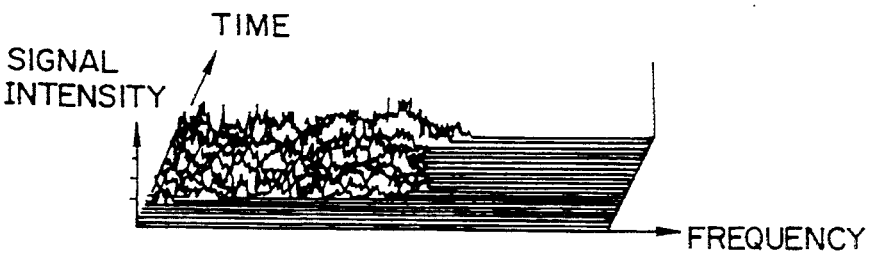

FIG. 1A shows the measured results for middle bow pressure and speed, FIG. 1B shows the measure results for high bow pressure and low bow speed, and FIG. 1C shows the measured results for low bow pressure and high bow speed. From these measured results, it has been found that low frequency components are related to the bow pressure and high frequency components are related to the bow speed.

The first embodiment of a tone controller of the present invention uses such knowledge to generate from Friction sound a tone control signal for bow speed and pressure.

Figure 2:
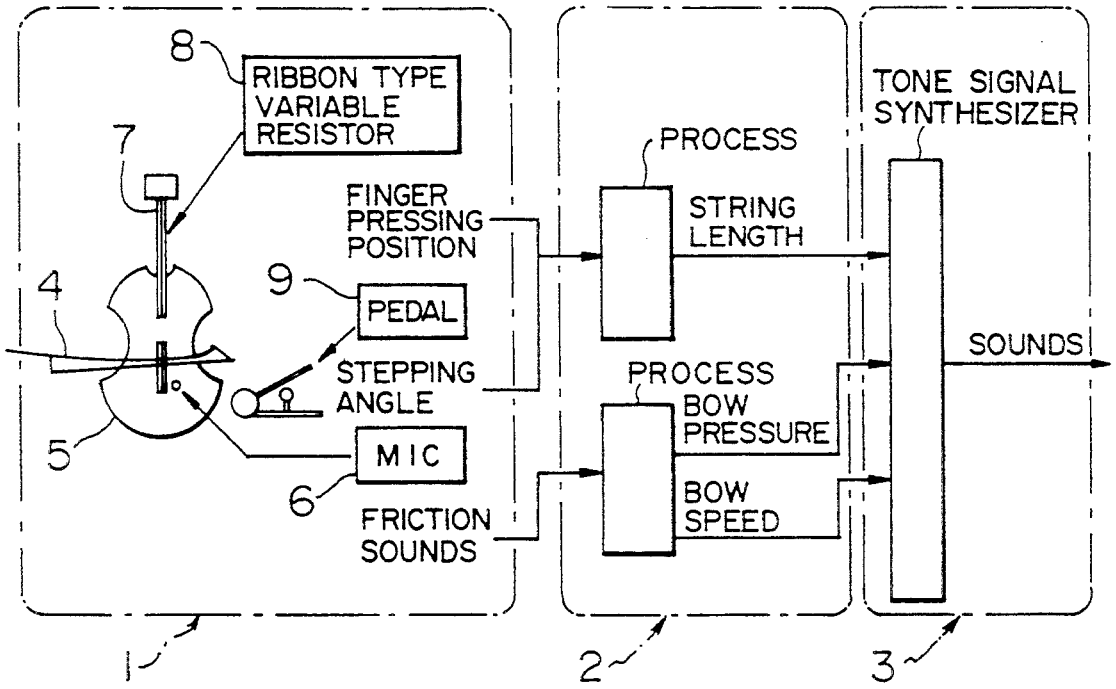
FIG. 2 shows the overall structure of a tone controller according to a first embodiment of the present invention.

FIG. 2 shows the overall structure of the tone controller of the first embodiment. In FIG. 2, reference numeral 1 represents an input unit, reference numeral 2 represents a signal processor, and reference numeral 3 represents a tone signal synthesizer unit.

At the input unit 1, a player couples a movable playing member such as a bow 4 to the body of a musical instrument, and draws the bow relative to the instrument body to play music. Using generated friction sounds, the signal processor 2 generates performance parameters for bow speed and pressure. The tone signal synthesizer 3 includes for example a physical model tone signal synthesizer, and produces tone signals in accordance with these performance parameters.

Figure 3:
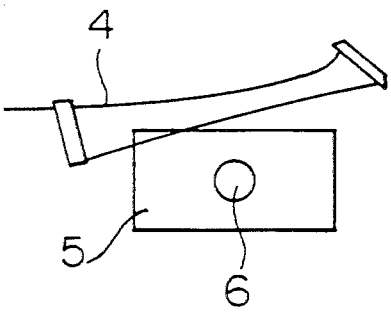
FIG. 3 is a schematic diagram showing the structure of an input unit according to the first embodiment of the present invention.

FIG. 3 shows the structure of the input unit 1. Friction sounds generated by the bow 4 and a string counterpart member 5 fixed to the instrument body are picked up by a microphone (friction sound detecting means) 6. The pitch to be designated on a finger board 7 is detected by a ribbon type variable resistor 8.

When a pedal 9 is stepped on, the stepping angle is detected by an angle sensor (not shown) and a signal is generated for performing a process corresponding to switching between a plurality of strings of a natural musical instrument. The string counterpart member 5 may be made of aluminum. The microphone 6 may be a piezoelectric element type shock sensor.

As shown in FIG. 2, the signal processor 2 converts the signals from the ribbon type variable register 8 and pedal 9 into pitch signals representing the string and string length, and converts the signal from the microphone 6 into tone control signals representing the bow pressure and speed.

Figure 4:
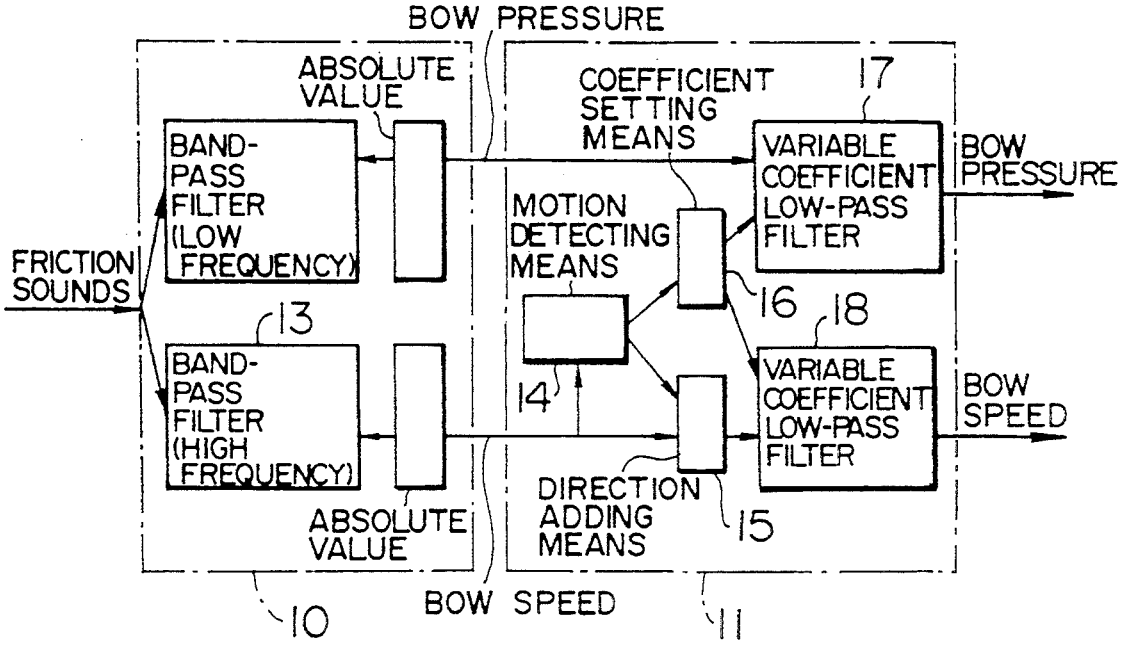
FIG. 4 is a block diagram showing the signal processor according to the first embodiment of the present invention.

A bow pressure signal/bow speed signal processor of the signal processor 2 has a first processor 10 and a second processor 11 as shown in FIG. 4.

In the first processor 10, a signal from the microphone 6 is passed through a low frequency band-pass filter 12 and a high frequency band-pass filter 13. The absolute values of the outputs of the filters 12 and 13 are used for generating original signals for bow pressure and speed. These original signals still contain a considerable amount of irregularly changing components (unnecessary noise components), and are improper for using them directly as tone drive signals. It is therefore necessary to eliminate such irregularly changing components through a filtering process. This process is executed by the second processor 11.

The second processor 11 is constructed of a string motion detecting means 14, a direction adding means 15, a filter coefficient setting means 16, and variable coefficient low-pass filters 17 and 18. The sampling frequency used by the first processor 10 may be set to 50 kHz, and that used by the second processor 11 may be set to 200 Hz.

Figure 5:
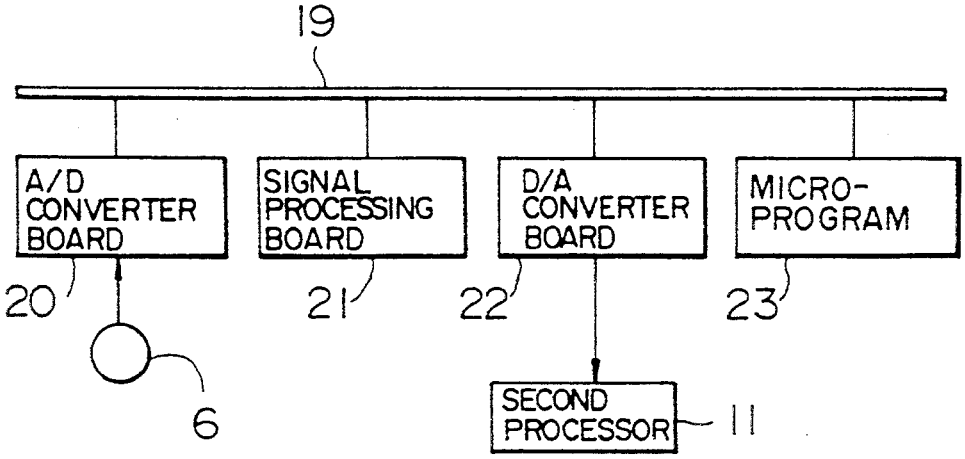
FIG. 5 is a diagram showing the hardware arrangement of the first processor of the signal processor according to the first embodiment of the present invention.

FIG. 5 shows the hardware arrangement of the first processor 10.

In FIG. 5, a signal from the microphone 6 is supplied via an A/D converter board 20 and a bus line 19 to a signal processor board 21. The signal processor board 21 provides the function of the first processor 10 of the signal processor 2. The processed signal is supplied to a D/A converter board 22 via the bus line 19, and converted into an analog signal which is then supplied to the second processor 11. A microprogram 23 to be used by the first processor 10 is supplied to the signal processor board 21 via the bus line 19.

The shock sensor used as the microphone 6 of this embodiment has a fairly large electromotive force so that is directly connected to the A/D converter board 20 without using an amplifier. An amplifier may be used if necessary.

Figure 6:
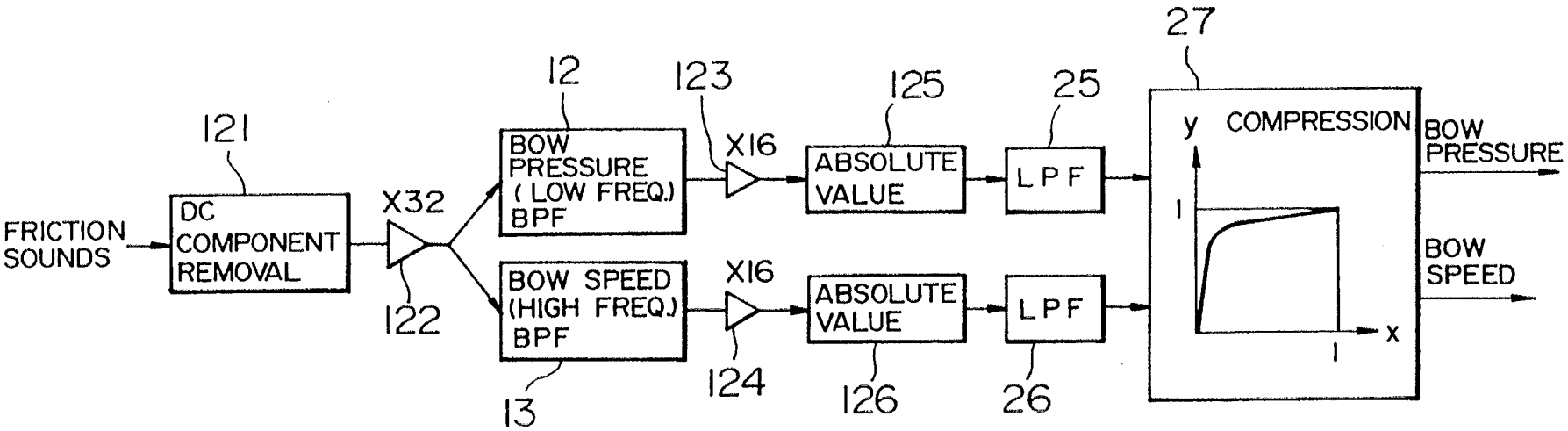
FIG. 6 is a block diagram of the first processor shown in FIG. 5.

FIG. 6 is a block diagram showing the more detailed structure of the first processor. The d.c. component of friction sounds is first eliminated by using a d.c. component eliminating means 121 such as a capacitor. The reason for this is that an output of the shock sensor (microphone 6) contains a d.c. offset voltage.

The friction sounds with its d.c. component having been eliminated is multiplied by 32 and supplied to the bow pressure and speed band-pass filters 12 and 13. A second order band-pass filter having a center frequency 0.5 kHz and a bandwidth +/−0.26 kHz was used as the bow pressure low frequency band-pass filter 12, and another second order band-pass filter having a center frequency 3.5 kHz and a bandwidth +/−1.0 kHz was used as the bow speed high frequency band-pass filter 13. These filter parameters were determined while considering the spectrum of a friction sound signal outputted from the input unit 1.

A signal passed through the band-pass filter is multiplied by 16, and its absolute value is obtained by using an absolute value circuit 125, 126 made of a full-wave rectifier circuit or the like.

A low-pass filter 25, 26 connected to the absolute value circuit 125, 126 is used for preventing aliasing. Thereafter, data compression is performed by a data compression unit 27 in order to improve an S/N ratio of a small signal. The relationship between an input signal x and output signal y of the compression unit 27 is represented by $y=1\sim(1\sim x)^4$, assuming that, both the definition area and value area are [0, 1]. Accordingly, noises of a small signal is reduced by $\frac{1}{4}$.

Figure 7A:
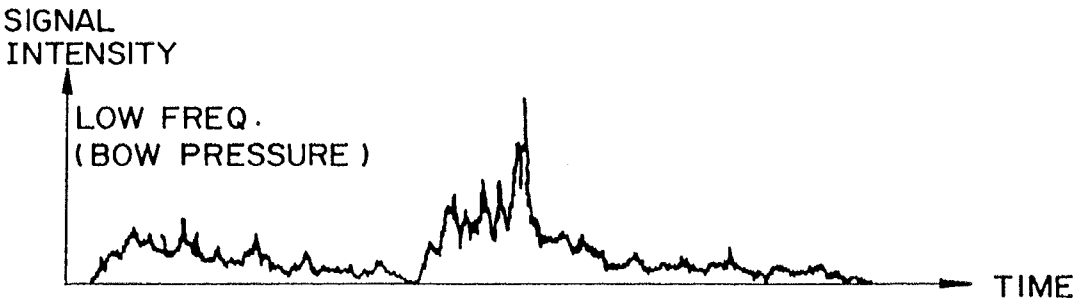
FIGS. 7A and 7B are diagrams showing examples of output signals of the first processor shown in FIG. 5.
Figure 7B:
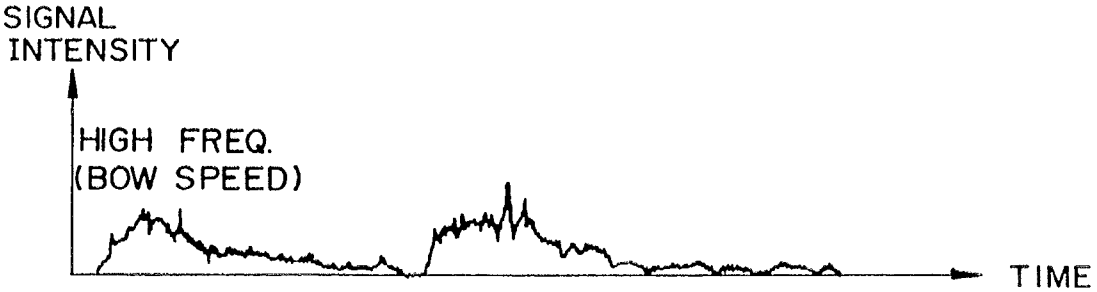

Examples of the output signals of the first processor 10 are shown in FIGS. 7A and 7B. FIG. 7A shows the intensity of a bow pressure signal, and FIG. 7B shows the intensity of a bow speed signal. The abscissa represents time, and the ordinate represents the signal intensity.

At the second processor 11, the signal supplied from the first processor 10 is subjected to an A/D conversion process to sample the signal every 5 ms, and thereafter processed for smoothing the irregular component of the signal or for other necessary operations.

in the above context, the following points should be taken into consideration.

Figure 8A:
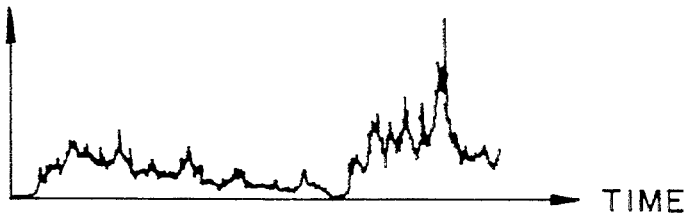
FIGS. 8A and 8B are diagrams showing examples of input and output signals of the first processor shown in FIG. 5, the output signal being simply passed through a low-pass filter.
Figure 8B:
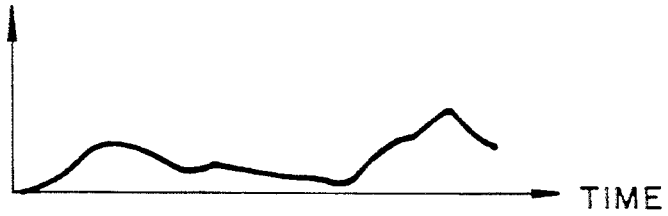

(1) If a given signal is simply passed through the low-pass filter, not only the noise component but also a signal component having a rapid change such as a sound head portion, a sound generated when the direction of bow motion is reversed, and the like, are removed. This is not desirable. For example, if a signal such as shown in FIG. 8A is simply passed through a low-pass filter, a signal such as shown in FIG. 8B is obtained.

(2) The two signals obtained by the first processor 10 are not fully independent.

Figure 9A:
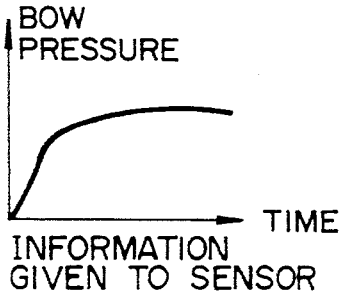
FIGS. 9A to 9D show examples of output signals of the first processor shown in FIG. 5, FIGS. 9A and 9B show input signals for the bow pressure and speed, FIGS. 9C and D show output signals for the input signals shown in FIGS. 9A and 9B.
Figure 9C:
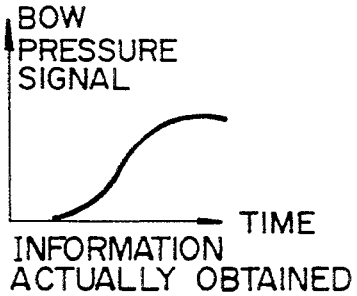
Figure 9B:
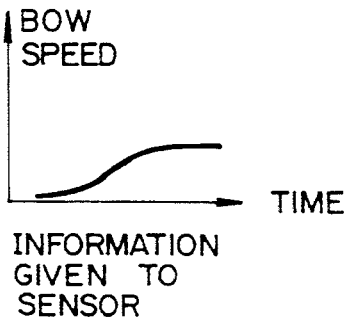
Figure 9D:
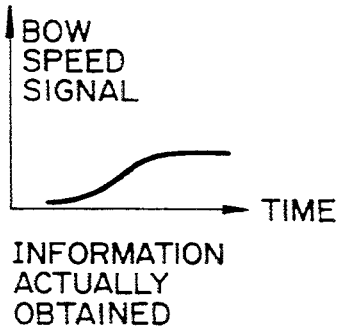

For example, consider a bow pressure and speed shown in FIGS. 9A and 9B and applied to the input unit 1. The obtained bow pressure signal and bow speed signal are such as shown in FIGS. 9C and 9D. The bow pressure signal does not coincide with the actual bow pressure. The reason for this is that no friction sound is generated and a bow pressure signal will not be obtained even if a certain bow pressure is applied, unless the bow is moved.

In order to solve these problems, the following methods are used.

(1) A low-pass filter capable of changing the cutoff frequency at proper timings is used not to eliminate the high frequency signal too much for the signal portion having a rapid change such as a sound head portion.

Figure 10A:
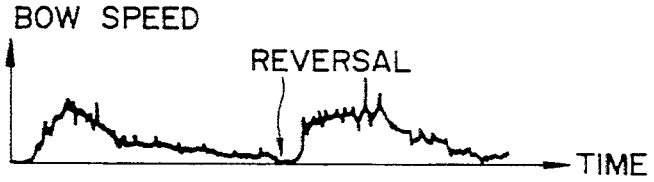
FIGS. 10A and 10B are diagrams showing a bow speed output signal with an inverted sign.
Figure 10B:
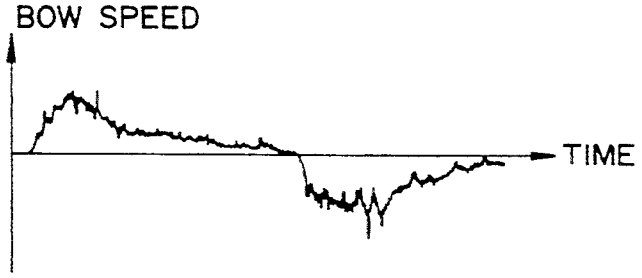

(2) For the bow speed data processing, an input signal such as shown in FIG. 10A is supplied with sign information for inverting the sign of a bow speed signal each time the bow is moved reversely. The resultant signal is shown in FIG. 10B. In this manner, the sharp V-character shaped waveform contained in the absolute data near at the reversal of the bow motion, is changed to a smooth curve.

Figure 11:
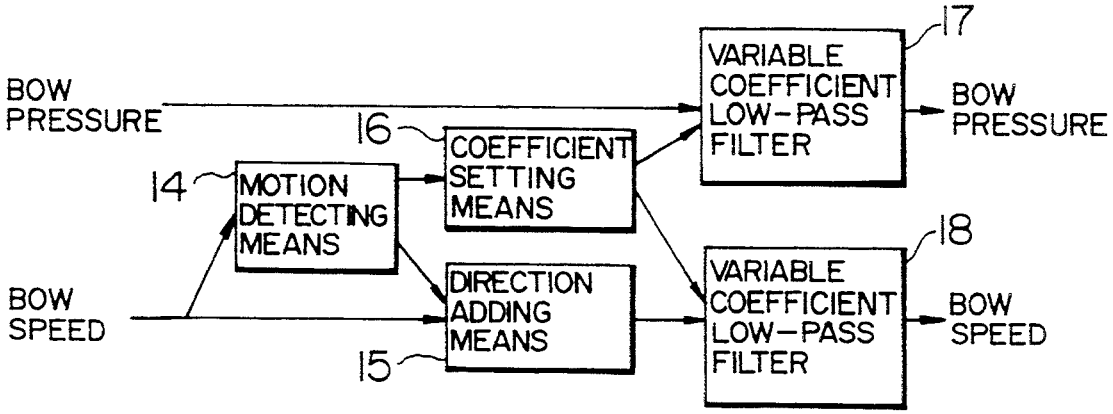
FIG. 11 is a block diagram of the second processor of the signal processor according to the first embodiment.

As shown in FIG. 11, in order to realize the above methods, the second processor uses the motion detecting means 14 for detecting the motion state of the bow from the input value of the bow speed and the direction adding means 15 for adding the direction of the bow speed basing upon the detection result, as well as the variable coefficient low-pass filters 17 and 18 and the filter coefficient setting means 16 for determining the cutoff frequencies of the variable coefficient low-pass filters basing upon the output of the motion detecting means 14.

The variable coefficient low-pass filter 17, 18 can change its cutoff frequency at proper timings, so that the high frequency component having a rapid change such as a sound head portion is not eliminated too much. Namely, the irregular signal component of an input signal is smoothed without losing the characteristics of signals at the motion start, stop, and bow motion reversal.

The direction adding means 15 changes the sharp V-character shaped waveform contained in the absolute value near at the bow reversal portion to a smooth curve traversing from the positive side to the negative side or vice versa. To this end, the direction adding means 15 inverts the sign of the bow speed value. The bow pressure and speed inputs which are not independent are processed and added with specific information to allow a stable drive of the tone signal synthesizer.

The operation of each circuit portion will be detailed below.

The motion detecting means 14 determines and outputs the motion state of the bow by using the bow speed data. The motion state discriminated by the motion detecting means 14 includes three states, i.e., a motion start (an instant when the bow is moved), a motion stop (an instant when the bow is stopped or detached from the string counterpart member 5), and a motion reversal (an instant when the bow is moved reversely).

The motion detecting means 14 outputs a "nil" signal for the motion other than the three motion states. The motion detecting means 14 stores other two states including a state (sound generating state) representing that the bow is presently moving and a state (bow speed reducing state) representing that the bow speed value is rapidly reducing.

The flow chart of detecting the bow motion is shown in FIG. 12.

At step S1 the states of the bow and a value one cycle time before are set as initial settings. Namely, registers for the motion state, sound generation state, and bow speed reducing state of the bow one cycle time before are set with "nil", "no sound generation", and "gentle", respectively, and a value register is set with "0".

At step S2, a current value is substituted to a register for the current value. After passing through the four conditional branches, the control returns to step S2.

At step S3 of the first conditional branch, it is checked whether the bow motion state is the motion start. Namely, it is checked whether the content of the sound generation register is "no sound generation" one cycle time before and whether the current value is equal to or larger than a motion start threshold value. If Yes, the control follows an Y arrow to advance to step S4 whereat "motion start" is registered in the motion state register and "sound generation" is registered in the sound generation register and thereafter the control advances to step S10.

If the judgment at step S3 is No, the control advances to step S5. The motion start threshold value used at step S3 is set higher than the noise level to suppress too sensitive response.

At step S5 of the second conditional branch, it is checked whether the motion state is the motion stop. Namely, it is checked whether the content of the sound generation state register is "sound generation" one cycle time before and whether the current value is smaller than a motion stop threshold value. If Yes, the control follows an Y arrow to advance to step S6 whereat "motion stop" is registered in the motion state register and "no sound generation" is registered in the sound generation state register, and thereafter the control advances to step S10.

If the judgment at step S5 is No, the control advances to step S7. The motion stop threshold value used at step S5 is set a little lower than the motion start threshold value so as not to terminate sounds too earlier.

Figure 13:
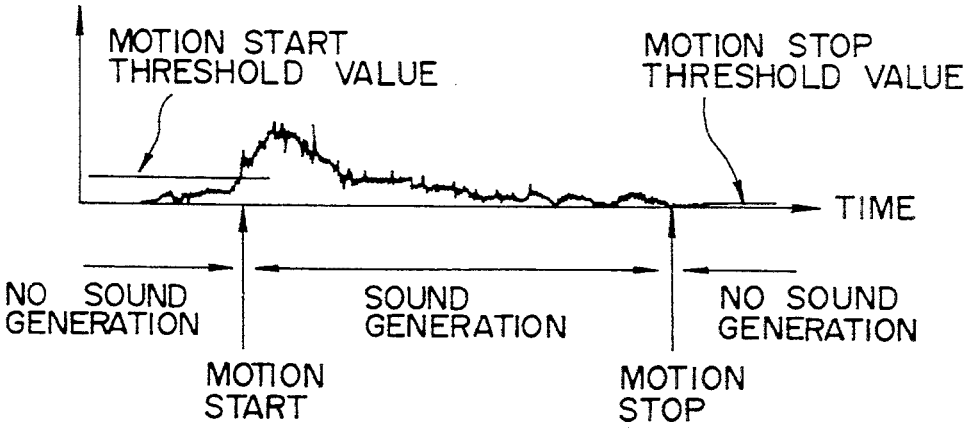
FIG. 13 is a diagram explaining threshold values for the motion start and stop in the motion detecting operation shown in FIG. 12.

FIG. 13 is a diagram explaining the motion start and stop threshold values. With the normalize, d maximum input value "1", the operation start threshold value is set to 0.008 for example, and the operation stop threshold value is set to 0.0005 for example.

Figure 14:
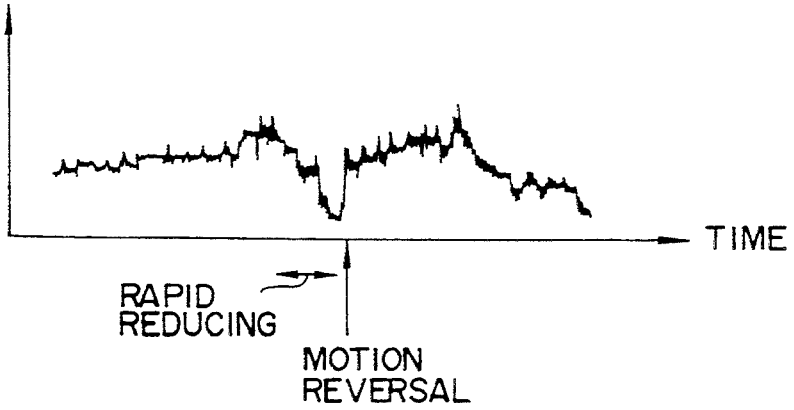
FIG. 14 is a diagram explaining the motion reversal in the motion detecting operation shown in FIG. 12.

At step S7 of the third conditional branch, it is checked if the motion state is the motion reversal. If the bow is slowly reversed, the motion first stops and then starts again. If the bow is reversed rapidly, the motion stop cannot be detected in the case where the value does not reduce smaller than the motion stop threshold value. This problem can be solved by the conditional branch at step S7. As shown in FIG. 14, the point at which the value reduces rapidly one cycle time before and it increases at the current cycle time, is judged as the motion reversal instant.

Specifically, at step S7 it is checked whether the content of the sound generation stale register is "sound generation" one cycle time before, whether the content of the bow speed reducing state register is "rapid", and whether the current value is larger than that one cycle time before. If Yes, the control follows an Y arrow to advance to step S8 whereat "motion reversal" is registered in the motion state register and "sound generation" is registered in the sound generation state register, and thereafter the control advances to step S10.

If the judgment at step S7 is No, the control follows an N line to advance to step S9. At step S9 "nil" is registered in the motion state register, the sound generation state one cycle time before is written in the sound generation state register, and thereafter the control advances to step S10.

Figure 15:
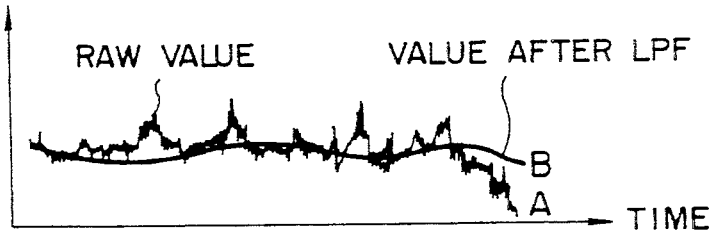
FIG. 15 is a diagram explaining a rapid reduction in the motion detecting operation shown in FIG. 12.

At step S10 of the last conditional branch, checked whether the value reduces rapidly. This judgment result is registered in the bow speed reducing state register at steps S11 and S12. A rapid reduction of the value occurs immediately before the bow motion reversal or immediately before the detachment of the bow from the string counterpart member. As shown in FIG. 15, for the judgment rapid reduction, the current value A of an original signal is compared with a value B passed through a low-pass filter. If the value A/B is smaller than a predetermined value (e.g., 0.4), it is judged as a rapid reduction, whereas if the value A/B is equal to or larger than the predetermined value, it is judged as a gentle reduction. This low-pass filter may be structured as a first order IIR with its coefficient 0.1 (cutoff value is about 3.4 Hz).

Thereafter, at step S13 the content of the motion state register is outputted to the filter coefficient setting means 16 and direction adding means 15.

Irregularity of the value becomes conspicuous particularly near the instant of the motion start and motion reversal. This irregularity may cause repetitive judgments by the motion state register as the motion start or motion reversal in a short time duration like a kind of chattering. In order to solve this problem, it is preferable not to output the content of the motion state register for a predetermined time period (e.g., 50 ms) immediately after the motion start and motion reversal.

At step S14 the current motion state, sound generation state, bow speed reducing state, and bow speed value are written as those one time cycle before in the motion state register, sound generation state register, bow speed reducing state register, and value register, respectively, to update the contents thereof, and thereafter the control returns to step S2.

The direction adding means 15 adds the sign information to the bow speed value in accordance with the output signal from the motion detecting means 15. The sign is inverted each time the motion start and motion reversal occur.

Next, the filter coefficient setting means 16 will be described.

Figure 16A:
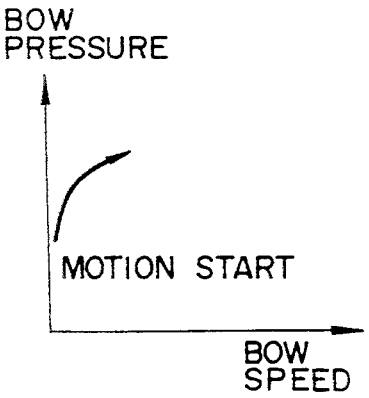
FIGS. 16A to 16C are diagrams showing the relationships between the bow pressure and speed when actually playing a natural stringed instrument using a bow.
Figure 16B:
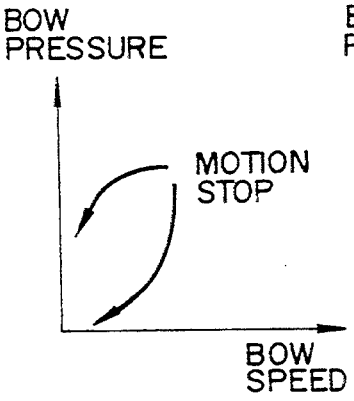
Figure 16C:
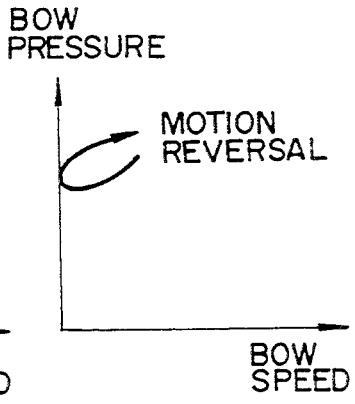

In playing a natural stringed instrument by drawing a bow, in many cases the bow pressure increases its value before the bow speed increases at the time of the motion start as shown in FIG. 16A. At the time of the motion stop, either the bow pressure or the bow speed takes a value 0 as shown in FIG. 16B. At the time of the motion reversal, in many cases the bow pressure does not take a value 0 as shown in FIG. 16C.

However, the bow pressure and speed signals obtained by the first processor increase or decrease generally the same manner at the times of the motion start, motion stop, and motion reversal, without reflecting the actual physical quantities correctly and losing the characteristics of the signals at the motion start, motion stop, and motion reversal. Namely, if the signals obtained by the first processor 10 are passed through the filters without any particular process, not only the noise component but also necessary signals having a rapid change are eliminated.

In view of this, in addition to the smoothing operation of an irregular signal component, the filter coefficient setting means 16 determines the cutoff frequencies of the filters in accordance with the bow motion and adds the direction to the bow speed, in order to provide characteristic information at the motion start, motion stop, and motion reversal. Specifically, the filter coefficient setting means 16 executes the following processes in response to an output signal from the motion detecting means 14.

At the time of the motion start: The filter coefficients are set so as to raise the cutoff frequencies of the variable coefficient low-pass filters 17 and 18 for the bow pressure and speed, thereby reflecting the rapid value (absolute value) increase to the output at the time of the motion start and during some time period thereafter. Furthermore, in order to increase the bow pressure before the bow speed increases, the cutoff frequency for the bow pressure filter is set higher than that for the bow speed.

After the motion start: After a certain time lapse from the motion start, the cutoff frequencies of the two filters are set lower to reduce a change of a irregular value.

At the time of the motion stop:

The cutoff frequencies of the two variable coefficient low-pass filters 17 and 18 are again set higher to reduce the value quickly at the time of the motion stop. In this case, the higher the cutoff frequency of the bow pressure filter is set, the more the motion resembles the performance of stopping a sound by detaching the bow from the string counterpart member. On the contrary, the lower the cutoff frequency of the bow pressure filter is set, the more the motion resembles the performance of stopping a sound while pushing the bow against the string counterpart member. The higher the cutoff frequencies of both the variable coefficient low-pass-filters 17 and 18 are set, the faster a sound attenuates. On the contrary, the lower the cutoff frequencies are set, a sound attenuates with the more trailing tone. The optimum coefficients are determined considering the above-described features. With this method however, there is a limit that, only one of the two sound attenuating variations can be selected.

At the time of the motion reversal:

Similar to the motion start, the absolute value increase with a rapid change is directly reflected to the output at the time of the motion reversal and during some time period thereafter. The cutoff frequency of the variable coefficient low-pass filter 17 for the bow pressure not set so high as the motion start, but it is set such that the output value one cycle before has generally a smooth couple to the current output value.

At the motion start, it is necessary to set the cutoff frequencies fairly high in order to raise the bow pressure as quickly as possible. However, it is more important to smoothly couple the output value one cycle before to the current output value, because the bow pressure already has some value immediately before the motion reversal.

It is not necessary to consider the cutoff frequency of the variable coefficient low-pass filter 18 for the bow speed more strictly than the motion start. This is because the value changes rapidly even if the cutoff frequency is low, because the input bow speed is added with the direction information.

Examples of the outputs of the variable coefficient low-pass filters 17 and 18 whose characteristics are set by the filter coefficient setting means 16 as shown in FIG. 17, are shown in FIGS. 18A and 18B. In FIGS. 18A and 18B, a fine line represents a signal before passing through the filter, and a bold line represents a signal after passing through the filter.

As seen from FIGS. 18A and 18B, the signal after passing through the filer directly reflects the signal before passing filter immediately after the motion start. After a certain time lapse from-the motion start, a change in an irregular signal becomes small. At the time of the motion reversal, the signal before passing the filter is reflected directly in the similar manner to the period immediately after the motion start. At the time of the motion stop, the signal value reduces quickly.

It is preferable for the bow motion reversal to set the filter coefficients such that the bow pressure value is maintained unchanged and only the bow speed is changed. In view of this, it is preferable that the coefficient of the bow pressure filter under operation is made small to lower the cutoff frequency thereof.

Figure 19A:
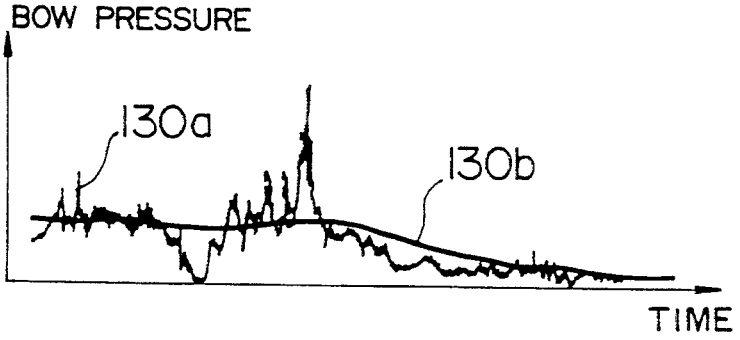
FIGS. 19A and 19B are diagrams showing bow pressure output signals of the second processor shown in FIG. 11.
Figure 19B:
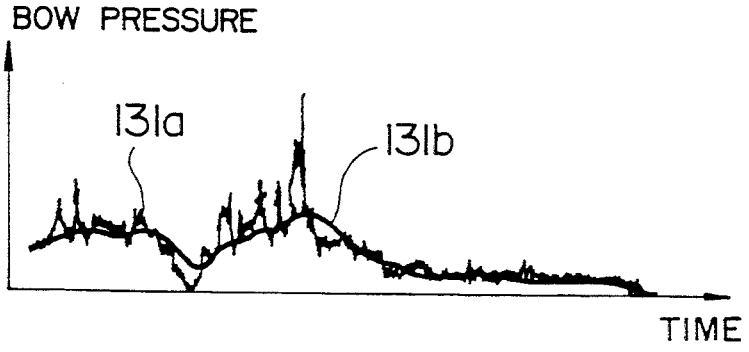

However, as shown in FIG. 19A, if the filter coefficient is set too small, although a change in the signal at the time of the motion reversal (at point 130*a* shown in FIG. 19A) is good, the tracking nature of the signal to the input value becomes bad at other points (such as point 130*b* shown in FIG. 19A). It is therefore difficult to provide an intensity change within one sound. FIG. 19B shows the bow pressure signal with the large filter coefficient. In this case, although the tracking nature of the signal to the input value is good at the time of signal change at point 131*b*, a change in the signal at the motion reversal at point 131*a* becomes too large.

This problem can be solved if the coefficient of the variable coefficient low-pass filter 17 for the bow pressure is made small only immediately before the motion reversal. Since the bow speed reducing state is rapid immediately before the motion reversal, the motion detecting means 14 is changed so as to newly output the reducing state. When the outputted reducing state is a rapid reducing state, the coefficient of the variable coefficient low-pass filter 17 for the bow pressure is reduced to 0.08 for example.

Figure 20:
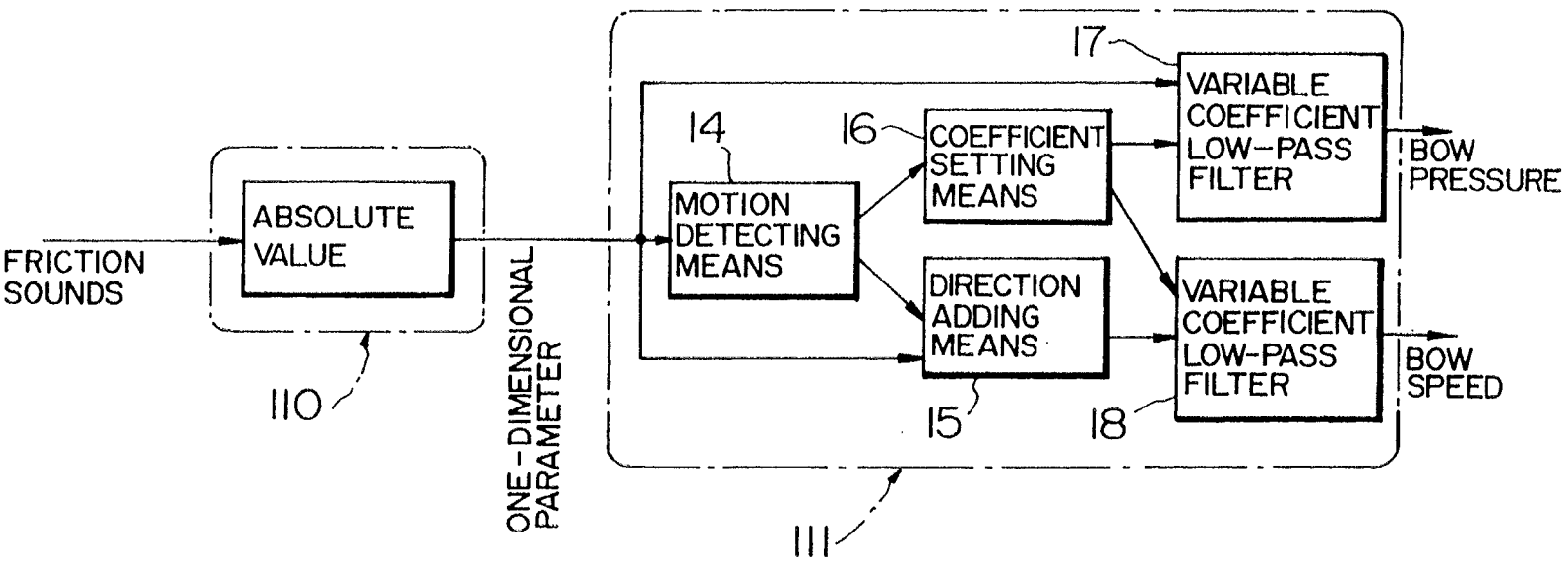
FIG. 20 is a block diagram off the tone controller according to another embodiment of the present invention.

FIG. 20 shows another embodiment of the signal processor of the tone controller according to the present invention. Other elements of this embodiment are similar to those shown in FIG. 2, and so the description thereof is omitted.

Referring to FIG. 20, the signal processor of this embodiment has a first processor 110 and a second processor 111. The second processor 111 is constructed of a motion detecting means 14, a direction adding means 15, a filter coefficient setting means 16, and variable coefficient low-pass filters 17 and 18.

In this embodiment as seen from FIG. 20, the structure of the first processor 110 is simplified because only the absolute value of a signal is obtained from a microphone picking up friction sounds. An output (one-dimensional time sequential data) from the first processor 110 is supplied to the second processor 111, and to both the variable coefficient low-pass filter 17 for the bow pressure and the variable coefficient low-pass filter 18 for the bow speed.

Use of the signal processor constructed as above neglects the balance between the bow pressure and speed given by the player, and deals with only the one-dimensional parameter of sound volume. Therefore, it is difficult to add information other than sound volume to an output sound to be produced by the tone signal synthesizer. However, reproduced output sounds resemble sufficiently those reproduced by natural stringed instruments using a bow. Therefore, this embodiment can be used as the tone controller for a stringed instrument allowing any novice to produce sounds.

Figure 21A:
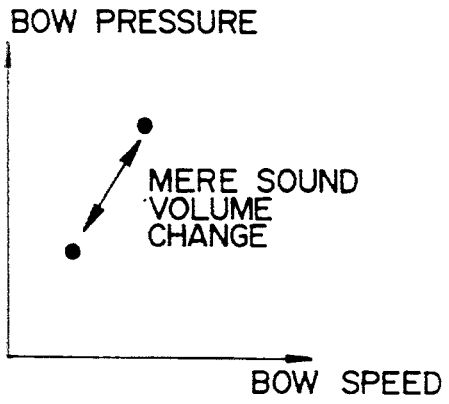
FIGS. 21A and 21B are diagrams showing examples of the bow speed and pressure signals.
Figure 21B:
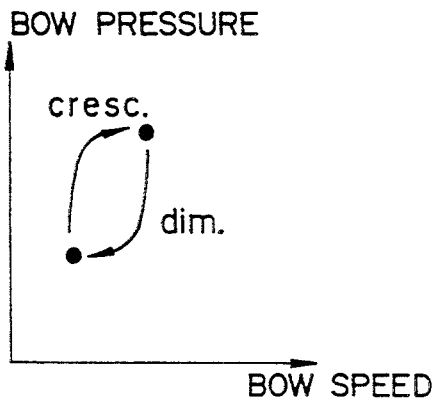

If a simple structure is used for the second processor for generating the bow pressure and speed from the one-dimensional parameter, both the bow pressure and speed increase or decrease at the same time as shown in FIG. 21A. In this case, audiences listen a generated sound as merely change in sound volume. Consider now the performance technique off changing greatly the dynamics of one sound by using an actual stringed instrument rising a bow. For example, in producing a rapid crescent as shown in FIG. 21B, the bow pressure is first increased, and then the bow speed is increased.

Conversely, in producing a rapid diminuendo, the bow pressure is first reduced, and then the bow speed is reduced. Taking these performances into consideration, the coefficient valises of the variable coefficient low-pass filters for the bow pressure and speed are set to different values. Namely, the coefficient used some time after the motion start, i.e., the bow speed coefficient, is made larger than the bow pressure coefficient so that the bow speed changes after the bow pressure changes, resembling a real stringed instrument using a bow. Such settings may preferably be used with the first embodiment.

Figure 22:
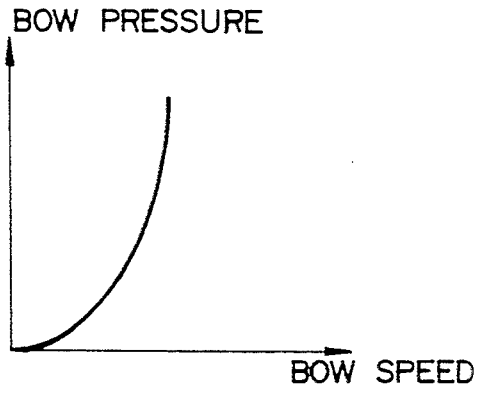
FIG. 22 is a diagram showing an example of an output signal of the signal processor of the second embodiment shown in FIG. 20.

Another method of producing sounds using the one-dimensional parameter, which sounds have the characteristics as if they were produced from a real stringed instrument using a bow, is to make a sound stiffer as the sound volume increases. This can be realized by setting the bow pressure output value to a square of the bow speed output value, as shown in FIG. 22.

Figure 23:
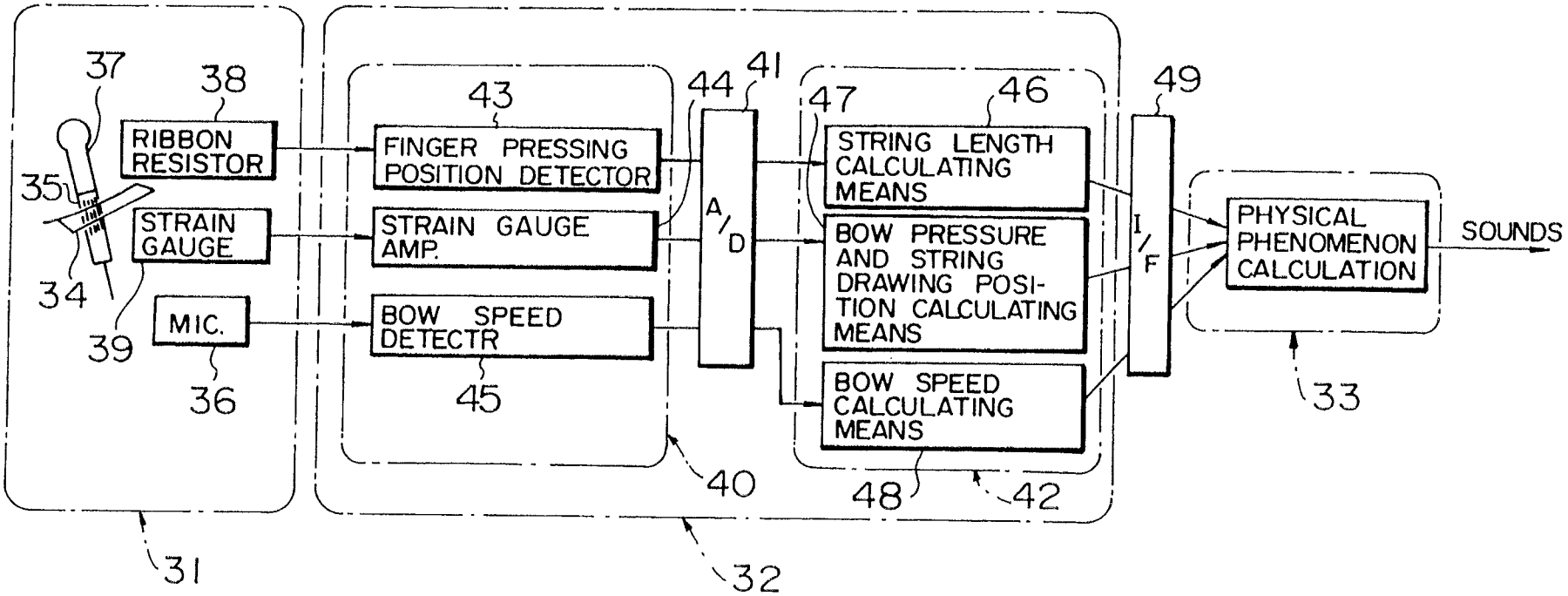
FIG. 23 is a block diagram showing the overall structure of the tone controller according to another embodiment of the present invention.
Figure 24:
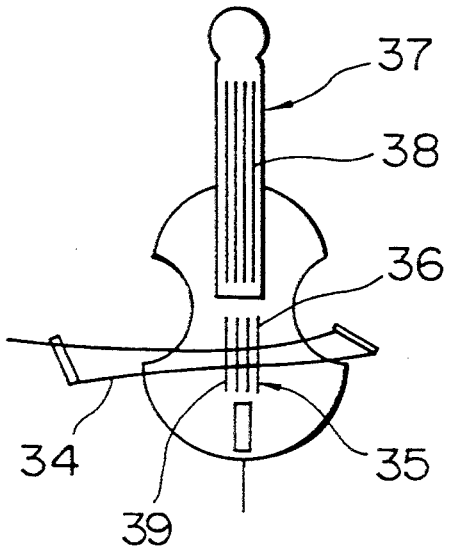
FIG. 24 is a schematic diagram following each sensor used with the embodiment shown in FIG. 23.

FIG. 23 shows the overall structure of another embodiment of a tone controller according to the present invention. FIG. 24 schematically shows the sensors of the input unit of the embodiment shown in FIG. 23.

This embodiment is applied to an electronic stringed instrument using a bow wherein the bow speed is generated from friction sounds generated by drawing a bow across a material body, and the bow pressure is generated by a strain gauge mounted on four string counterpart members.

Referring to FIG. 23, the tone controller is constructed of an input unit 31, a signal processor (signal processing means) 32, a tone signal synthesizer 33, and the like.

In the input unit 31, a player gives a performance by contacting a movable playing member such as a bow 34 to string counterpart members 35 extending along the instrument body and moving the former relative to the latter. Generated friction sounds are picked up by a microphone (friction sound detecting means) 35 provided for each string counterpart member 35, to thereby generate a bow speed.

The finger pressing position on a finger board 37 is detected by a ribbon type variable resistor 38. The bow pressure is detected by two strain gauges 39 provided for each string counterpart member 35. These signals detected at the input unit 31 are analog signals which are then inputted to the signal processor 32.

The signal processor 32 is constructed of an analog processor (first processor) 40, an A/D converter board 41, and a computation unit (second processor) 42. The analog processor 40 processes the analog signals supplied from the input unit 31 and outputs analog voltage values. These analog voltage values are converted into digital signals at the A/D converter board 41. The computation unit 42 processes the signals from the A/D converter board 41 and calculates and outputs tone control signals such as the string length, bow pressure, string drawing point, bow speed, and the like.

The analog processor 40 is constructed of a finger pressing position detector 43 connected to the ribbon type variable resistor 38 for detecting the finger pressing position, a strain gauge amplifier 44 connected to the strain gauges 39, and a bow speed detector 45 connected to the microphones 36.

The computation unit 42 is constructed of a string length calculating means 46 for calculating the string length basing upon a signal from the finger pressing position detector 43, a bow pressure and string drawing point calculating means 47 for calculating the bow pressure and string drawing point basing upon a signal from the strain gauge amplifier 44, and a bow speed calculating means 48 for calculating the bow speed basing upon a signal from the bow speed detector 45.

The tone control signals outputted from the signal processor 32 are supplied to a physical model tone signal synthesizer 33 via a tone signal synthesizer interface 49. In accordance with these tone control signals, the physical mode tone signal synthesizer 33 generates a corresponding tone signal. The physical model tone signal synthesizer simulates a tone generating mechanism of a natural musical instrument, and is disclosed for example in Japanese Patent Laid-open No. 3-206493 corresponding to U.S. Ser. No. 07/636,209, filed on Dec. 31, 1990, which is incorporated by reference, herein.

Figure 25A:
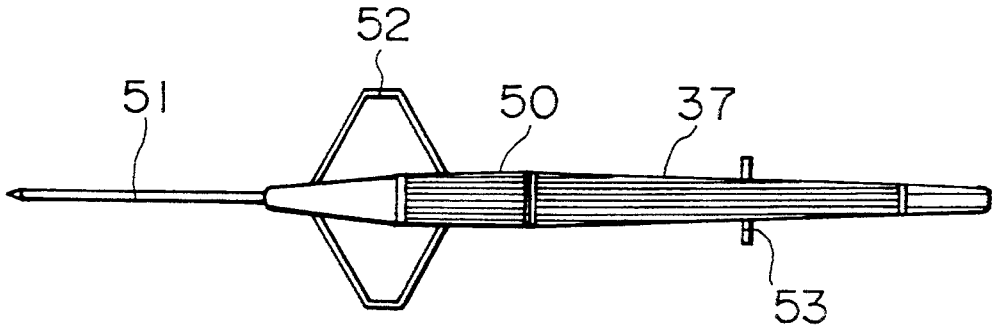
FIGS. 25A to 25C are diagrams showing the structure of the input unit of the embodiment shown in FIG. 23.
Figure 25B:
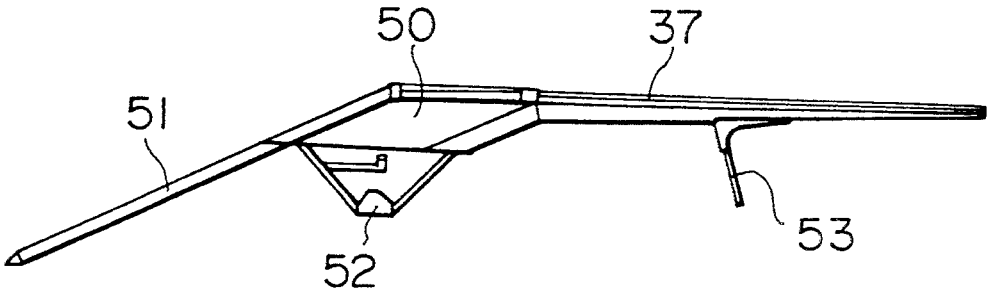
Figure 25C:
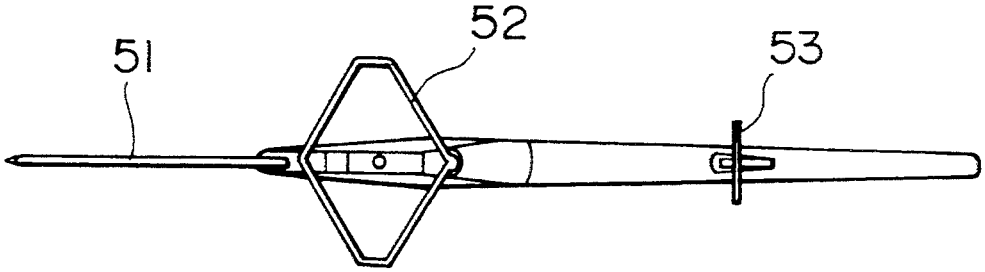

FIGS. 25A to 25C show the structure of the input unit 31. FIG. 25A is a front view of the input unit 31, FIG. 25B is a side view of the input unit 31, and FIG. 25C a rear view of the input unit 31. As shown in FIGS. 25A to 25C, the input unit 31 has a base 50, a finger board 37 fixed to one end of the base 50, and a support pin 51 fixed to the other end of the base. In order to easily hold in position the input unit 31 during giving a performance, a knee stop 52 is fixedly mounted to the base 50 and a breastplate 53 is fixedly mounted to the string plate.

Figure 26:
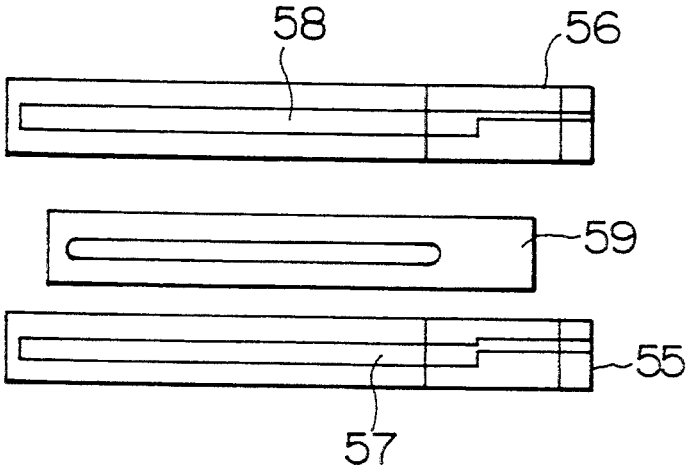
FIG. 26 is a diagram showing the structure of the ribbon type variable resistor of the embodiment shown in FIG. 23.

FIG. 26 is a schematic diagram showing the ribbon type variable resistor 38 for detecting a finger pressing position. This resistor 38 has two base films 55 and 56, and a spacer with a hole sandwiched between the two base films attached together. The base film 55 is printed with a conductive wire, and the other base film 56 is printed with a ribbon resistor 58. A voltage is applied between opposite ends of the ribbon resistor 58. When a prayer presses the conductive wire on the base film 55, the conductive wire 57 becomes in contact with the ribbon resistor 58 on the base film 56, allowing to pickup the potential signal at the contact point.

In order to make the string more realistic, the string may be a vinyl-coated conductive wire with its core leads being removed and with a black drafting tape covering it.

Figure 27:
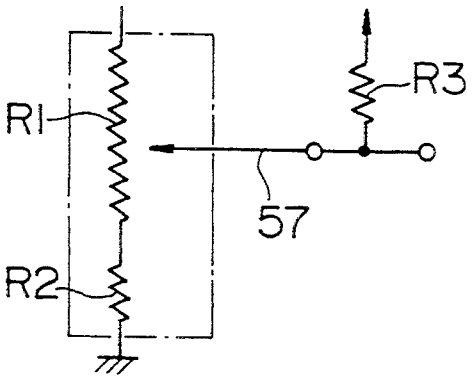
FIG. 27 is a circuit diagram showing the finger pressing position detector of the embodiment shown in FIG. 23.

FIG. 27 is a circuit diagram of the finger pressing position detector. In this embodiment, in the finger pressing position detector 43, a resister R1 (ribbon resistor 58) is serially connected to a resistor R2. A conductive wire 57 connected to a resistor R3 contacts the resistor R1 to output a potential at the contact point.

Figure 28:
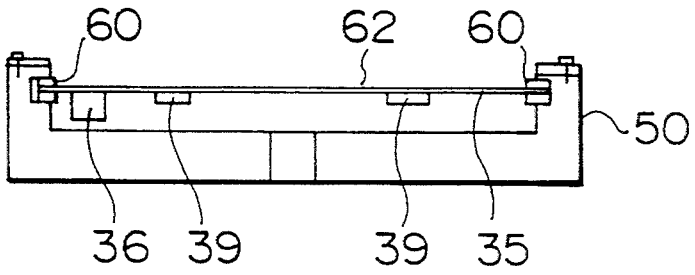
FIG. 28 is a cross sectional view of the bow pressure and speed sensor unit of the embodiment shown in FIG. 23.

FIG. 28 is a cross sectional view of a bow pressure and speed sensor corresponding to a single string counter part member. Opposite ends of the string counterpart member are mounted on the base 50 via felts 60. As the microphone 36, a microphone having two input terminals is used and bonded to the string counterpart member 35. Two strain gauges 39 are bonded to the string counter part member 35 as shown in FIG. 28.

The mount position of the microphone 36 is located, in the example shown in FIG. 28, on the side of the end (left side in FIG. 28) of the finger board 37 in order to lessen the stress to the string counterpart member 35. The mount position of the microphone is not limited to the embodiment position, but it may be any position if friction sounds generated by the bow 34 and string counterpart member 35 can be picked up.

Vibrations in the lateral direction of the string counterpart member 35 when the bow 34 is drawn across the member, can be prevented if a metal plate with some width is used as the string counterpart member 35. As the material of the string counterpart member 35, steel was used, and a protrusion 62 made of acrylonitrite butadiene styrene (ABS) resin was bonded thereto to make the string shape more realistic. It is therefore unnecessary to bend the string counterpart member 35 in a channel-shape, but the member can be used as an elongated plate.

The strain gauge 39 may be a semiconductor strain gauge having a resistance value 150Ω.

An output of each sensor is delivered via a board (not shown) mounted on the bottom of the base 50. The outputs of the strain gauge 39 and ribbon type variable resistor 38 are delivered directly, and an output of the condenser microphone 36 is supplied to an amplifier to deliver an output signal of a low impedance.

Figure 29:
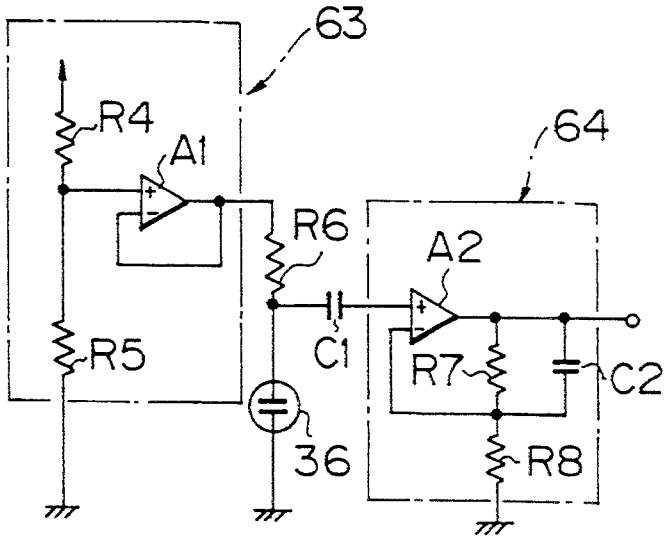
FIG. 29 is a circuit diagram of the microphone amplifier of the embodiment shown in FIG. 23.

FIG. 29 is a circuit diagram of an amplifier for each condenser microphone. In FIG. 29, a constant voltage circuit 63 made of resistors R4 and R5 and an operational amplifier A1, supplies a voltage of about 10 V to the condenser microphone 36 via a resistor R6. A signal from the condenser microphone 36 is supplied via a capacitor C1 to an amplifier 64 having also a low-pass filter function.

An output signal of an operational amplifier A2 of the amplifier 64 is fed back to the inverting terminal of the operational amplifier A2 via a circuit structured by a capacitor C2, and resistors R7 and R8. The gain of the amplifier 64 is set to about 11 for example.

Figure 30:
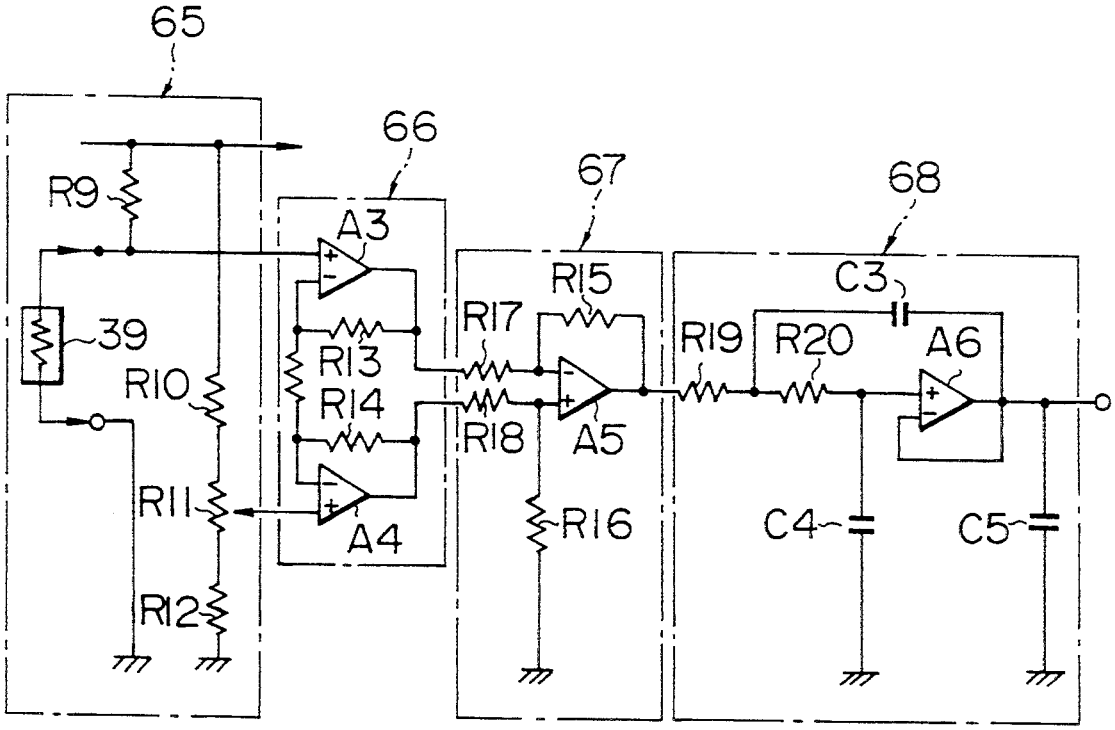
FIG. 30 is a circuit diagram of the strain gauge amplifier of the embodiment shown in FIG. 23.

FIG. 30 is a circuit diagram of the strain gauge amplifier 44 for each strain gauge. In FIG. 30, the strain gauge amplifier is constructed of a bridge circuit 65, a differential input non-inverting amplifier 66, a differential amplifier 67, and a low-pass filter 68.

The bridge circuit 65 is constructed of the strain gauge 39 and resistors R9 to R12, and detects a resistance change of the strain gauge 39. The strain gauge 39 has a resistance value 120Ω when there is no strain, and a resistance value 112Ω at the maximum strain. Since the resistance value varies with each strain gauge 89, the resistor R11 of the bridge circuit is adjusted to an optimum value for each gauge. An output of the bridge circuit 65 is supplied via the differential input non-inverting amplifier 66 to the differential amplifier 67.

Two operational amplifiers A3 and A4 are provided in the differential input non-inverting amplifier 66. The outputs of the operational amplifiers A8 and A4 are fed back via resistors R13 and R14.

The operational amplifier 67 has an operational amplifier AS, a resistor R15 connected between the output terminal and inverting input terminal of the operational amplifier AS, and a resistor R16 connected between the non-inverting input terminal of the operational amplifier A4 and ground. The output signals from the differential input non-inverting amplifier 66 are inputted via input resistors R17 and R18 to the inverting and non-inverting input terminals of the differential amplifier A5. The gain of the differential input non-inverting amplifier 66 is set to about 7.3 for example, and that of the differential amplifier 67 is set to about 25.6 for example.

The low-pass filter 68 is used for preventing aliasing, and has an operational amplifier A6 whose non-inverting terminal and output terminal are grounded via capacitors C4 and C5 and whose output is fed back to the non-inverting input terminal via a capacitor C3 and resistor R20. A signal from the differential amplifier 67 is applied via an input resistor R19 to the interconnection between a resistor R20 and capacitor C3. The low-pass filter 68 has a cutoff frequency 19 Hz.

From the experimental results of the bow pressure and speed sensor by actually drawing the bow across the string counterpart members, it has been found that the frequency components of friction sounds from about 10 kHz to 20 kHz can be used as the bow speed with less influence by the bow pressure. However, unless a considerably steep high-pass filter is used, it is difficult to derive desired frequency components. In view of this, a fifth order Chebyshev high-pass filer 70 shown in FIG. 31 was used.

Figure 31:
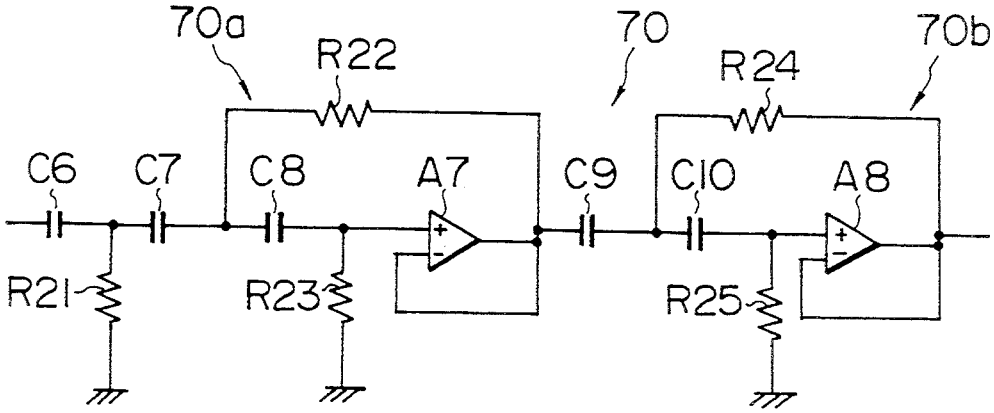
FIG. 31 is a circuit diagram of the Chebyshev high-pass filter used with the bow speed detector of the embodiment shown in FIG. 23.

The Chebyshev high-pass filter 70 shown in FIG. 31 has operational amplifiers A7 and A8. The output of the operational amplifier A7 is fed back to the non-inverting input terminal via a circuit constituted by a resistor R22 and capacitor C8. The non-inverting input terminal is grounded via a resistor R28. An input signal is applied to the non-inverting input terminal of the operational amplifier A7 via a circuit constituted by capacitors C6 and C7 and a resistor R2 and via a capacitor C8.

An output of the operational amplifier A8 is fed back to the non-inverting input terminal via a circuit constituted by a resistor R24 and a capacitor C10. The non-inverting input terminal is grounded via a resistor R25. An output signal from the operational amplifier A7 is supplied to the non-inverting input terminal of the operational amplifier A8 via capacitors C9 and C10.

An input signal to the Chebyshev high-pass filter 70 is applied to the first stage filter 70*a* via the circuit constituted by the capacitors C6 and C7 and resistor R21. An output from the first stage filter 70*a* is inputted via the capacitor C9 to the second stage filter 70*b*.

Figure 32:
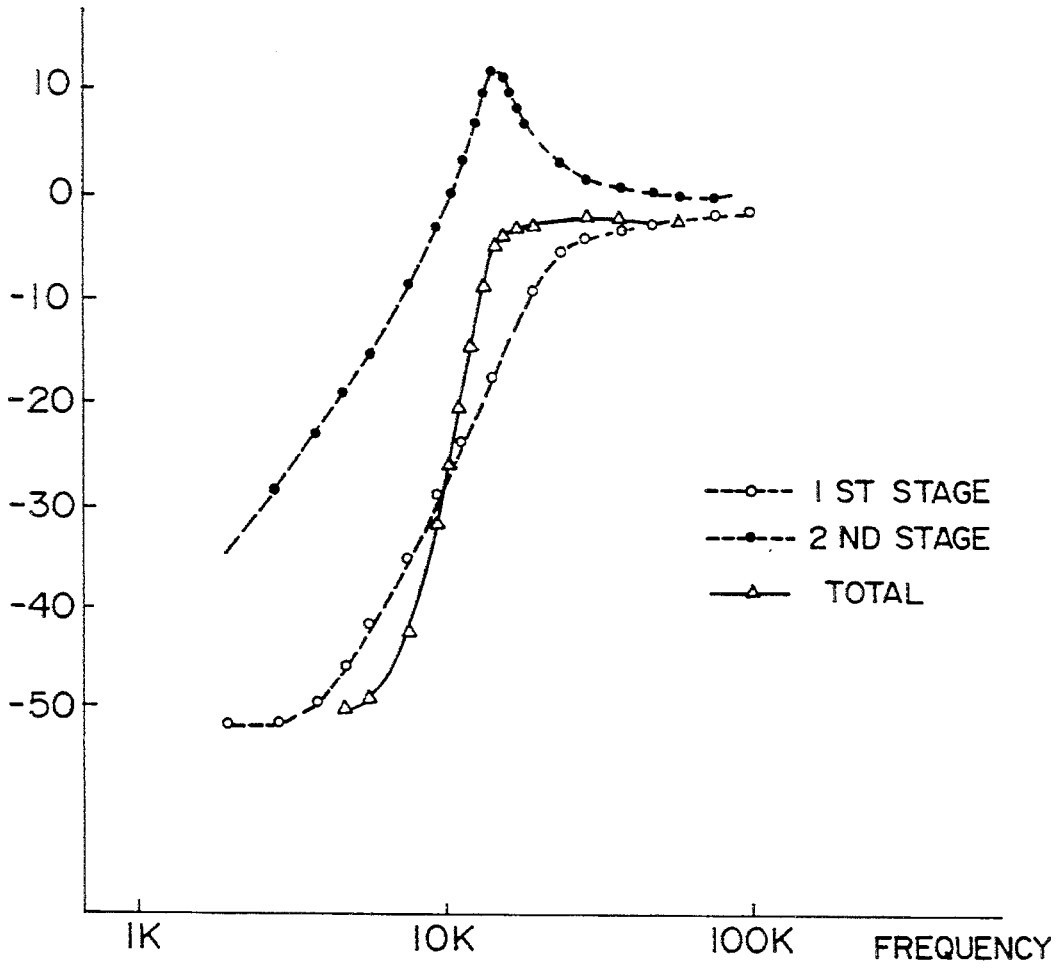
FIG. 32 is a graph showing the characteristics of the Chebyshev high-pass filter shown in FIG. 31.

The characteristics of the Chebyshev high-pass filter constructed as above are shown in FIG. 32, wherein the capacitance of each capacitor is 0.001 μF, and R21=2.79 KΩ, R22=1.23 KΩ, R23=43.16 KΩ, R24=0.949 KΩ, and R25=117.23 KΩ. FIG. 30 shows the characteristics of the first and second stage filters and the total characteristic of the Chebyshev high-pass filter 70.

Figure 33:
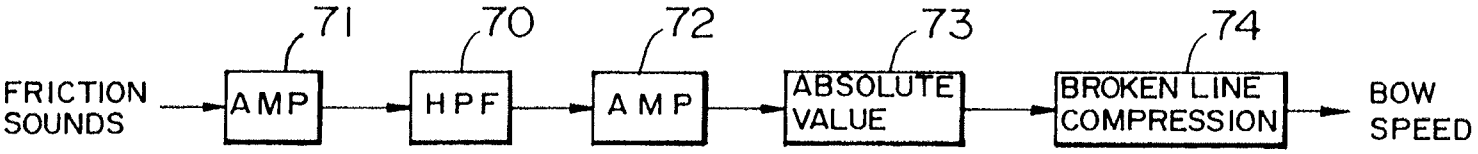
FIG. 33 is a functional block diagram of the bow speed detector of the embodiment shown in FIG. 23.

FIG. 33 is a functional block diagram of the bow speed detector. Friction sounds from the bow pressure and speed sensor unit are passed through an amplifier 71 and the Chebyshev high-pass filter 70, and amplified by an amplifier 72. Thereafter, an output from the amplifier 72 is applied to an absolute value circuit 73 to obtain the absolute value of the signal. Finally, this absolute value is compressed by a broken line compression circuit 74 in order to expand the dynamic range of the bow speed output signal.

Figure 34:
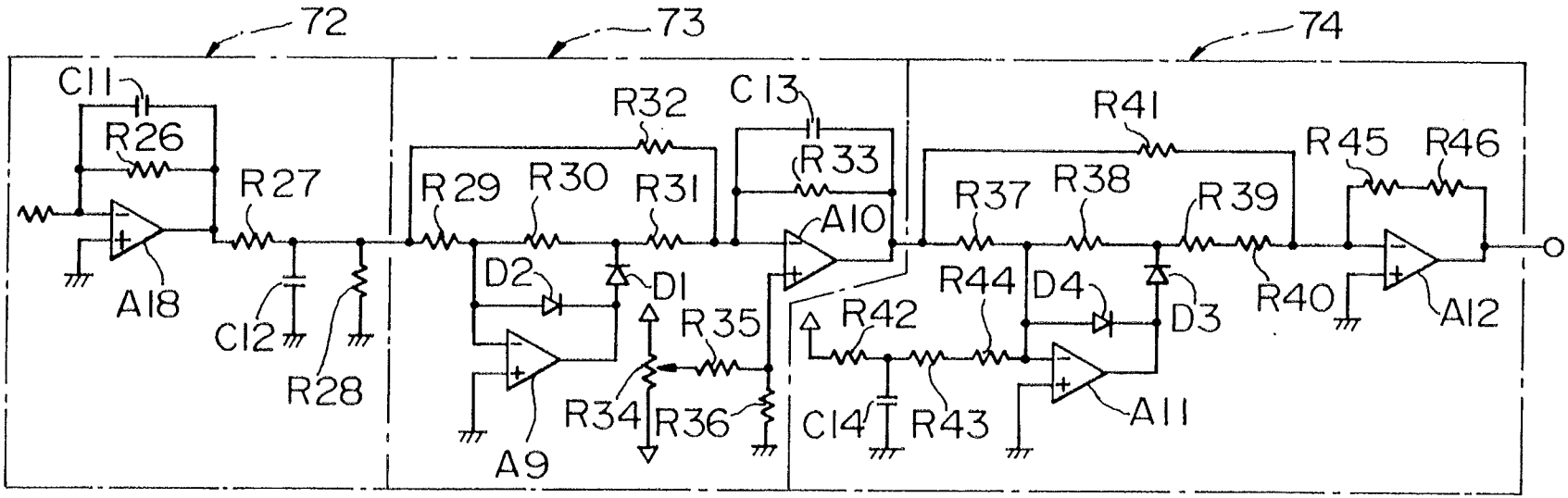
FIG. 34 is a circuit diagram of the amplifier, absolute value circuit, and broken line compression circuit, respectively of the bow speed detector of the embodiment shown in FIG. 23.

FIG. 34 is a circuit diagram of the amplifier 72, absolute value circuit 73, and broken line compression circuit 74. Referring to FIG. 34, an output signal of an operational amplifier A18 of the amplifier 72 is fed back to the non-inverting input terminal via a circuit constituted by a capacitor C11 and resistor R26. An output signal of the operational amplifier A18 is inputted to the absolute value circuit 73 constituted by a resistor R27, capacitor C12, and resistor R28.

The absolute value circuit 73 has a circuit constituted by operational amplifiers A9 and A10, and resistors R29 to F32. An output terminal of the operational amplifier A9 is connected via a diode D1 to the interconnection between the resistors R30 and R31. The inverting terminal is connected to the interconnection between the resistors R29 and R30, and the non-inverting terminal is grounded. The interconnection between the resistors R29 and R30 is connected via a forward diode D2 to the diode D1.

An output signal of the operational amplifier A10 is fad back to the inverting input terminal via a circuit constituted by a capacitor C13 and resistor R33. The non-inverting input terminal of the operational amplifier A10 is connected to a circuit constituted by resistors R34, R35, and R36.

An input signal from the amplifier 72 is supplied to the inverting input terminal of the operational amplifier A10 via a circuit constituted by the diodes D1 and D2, resisters R29 to R32, and operational amplifier A9.

The broken line compression circuit 74 includes a circuit constituted by operational amplifiers A11 and A12, and resisters R37 to R41. The output terminal of the operational amplifier All is connected via a diode D3 to the interconnection between the resisters R38 and R39, the inverting input terminal thereof is connected to a circuit constituted by a resistor R42, capacitor C14, and variable resistor F44, and the non-inverting terminal is grounded. A forward diode D4 is connected between the resistor R37 and diode D3. An output signal of the operational amplifier R37 is fed back to the inverting input terminal via a circuit constituted by resisters R45 and R46.

An input signal from the absolute value circuit 73 is supplied to the inverting input terminal of the operational amplifier A12 via a circuit constituted by the diodes D3 and D4, resisters R37 to R41, and operational amplifier A11.

Figure 35:
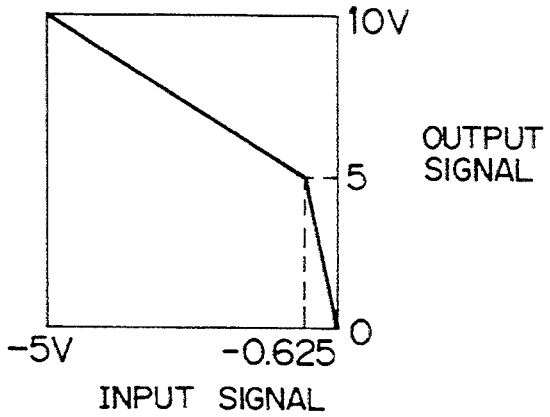
FIG. 35 is a diagram showing the compression characteristics of the broken line compression circuit shown in FIG. 34.

FIG. 35 shows an example of the compression characteristic of the broken line compression circuit 74. As seen from FIG. 35, the gain is set to about 8 for an input signal from 0 to −0.625 V, and set to about 1.1 for an input signal from −0.625 V to −5 V. The high absolute value range of the input signal is compressed to expand the input signal dynamic range.

In this embodiment, the computation unit 42 shown in FIG. 23 was realized by programs running on a personal computer (e.g., PC9801 series of NEC Corp.). Sixteen types of analog signals outputted from the analog processor 40 are inputted to the personal computer 42 via a 16-channel A/D converter board 4I (e.g., ANALOG-PROI of CANOPUS Kabushiki Kaisha), and the computed signals are sent to the tone signal synthesizer board 33 via the tone signal synthesizer interface board 49.

Two tone signal synthesizer boards 33 were used arid two tone signal synthesizer interface boards 49 were used to send signals separately to the two tone signal synthesizer boards 33. One of the two interface boards is structured to operate in response to external clocks.

Various string adjustments are possible by connecting a musical instrument digital interface (MIDI) board (e.g., MPU-PC98 of Roland Kabushiki Kaisha) to the personal computer 42 and receiving MIDI events outputted from dedicated tuning operators. These tuning operators may be used as a MID1 monitor in one of a string adjustment mode and MIDI monitor mode.

Next, the signal processing at the computation unit 42 will be described.

Figure 36:
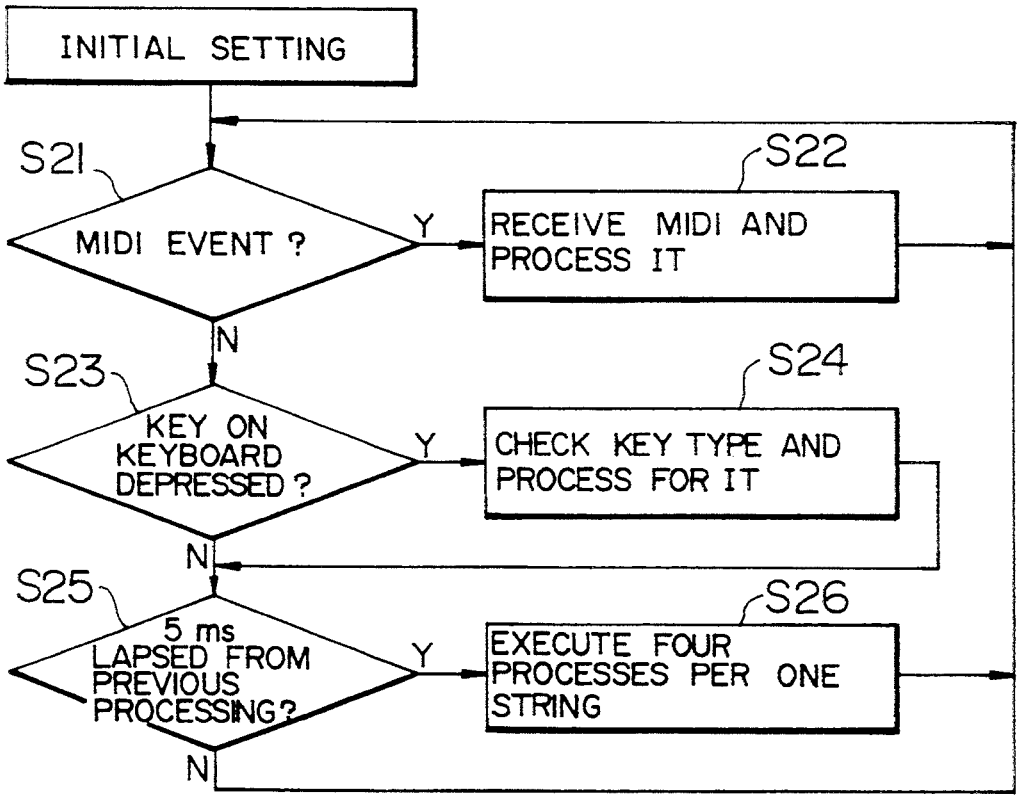
FIG. 36 is a flow chart showing the processes to be executed by the computation unit of the embodiment shown FIG. 23.

FIG. 36 is a flow chart briefly illustrating the signal processing to be executed by the computation unit 42. After the initial settings, an infinite loop is performed. The loop itself is not managed by time.

At step S21, it is checked whether there is an externally inputted MIDI event. If there is an inputted MIDI event, this event is processed at step S22 and thereafter the control returns to step S21. If there is no inputted MIDI event, the control advances to step S23 whereat it is checked whether any key on the keyboard of the personal computer 42 is being depressed.

If any key is being depressed, the control advances to step S24 to check the type of the depressed key and a corresponding process is carried out to advance to step S25. If no key is being depressed, the control advances directly to step S25 whereat it is checked whether it has lapsed 5 ms or longer after the previous signal processing was executed. If lapsed, the control advances to step S26 whereat four processes per each string counterpart member are executed.

Figure 37:
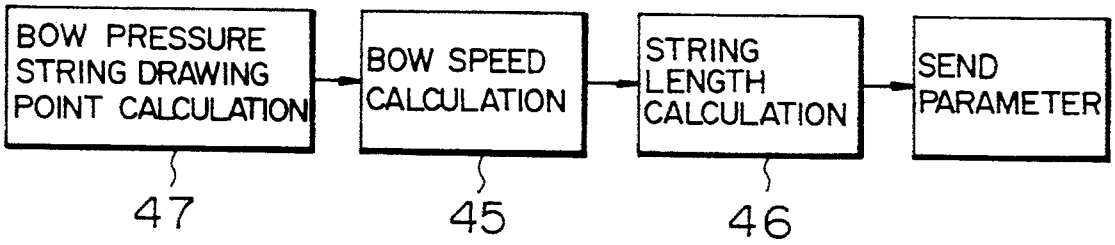
FIG. 37 is a block diagram showing the processes to be executed, for each string counterpart member, by the computation unit of the embodiment shown in FIG. 23.

FIG. 37 is a diagram showing the four processes per one string counterpart member. The processes per one string counterpart member includes four stages, i.e., bow pressure and string drawing point calculation, bow speed calculation, string length calculation, and tone control signal The former three calculation processes are independent so that the order of executing calculations may be set arbitrarily.

An A/D conversion is performed at the initial stage of each process. Specifically, the bow pressure and string drawing point calculating means 47 executes two A/D conversion operations because of a necessity of two strain values, and the bow speed calculating means 45 and string length calculating means 46 each execute one A/D conversion operation.

Each process to be executed by the string length calculating means 46, bow pressure and string drawing point calculating means 47, and bow speed calculating means 45, respectively of the computation unit 42, will be described below.

Bow pressure/string drawing point calculating means 47:

This calculating means 47 calculates the bow pressure and string drawing point from the outputs of the two strain gauges 39.

The output of the strain gauge 39 is likely to be influenced by temperature, the higher the ambient temperature, the smaller the output value. Also the strain gauge amplifier 44 in the analog processor 40 outputs a smaller value the higher the temperature. If no countermeasure is taken, the output value becomes negative and incompatible with the 0 to 10 V mode of the A/D converter board.

From the above reason, the resistors R10 to R12 of the strain gauge amplifier shown in FIG. 30 are adjusted so as to output a positive value large to some extent when the bow pressure is 0, and this offset is subtracted using a program. There is a case where the offset drifts during the musical performance. Therefore, in this embodiment, the offset is adapted to be calculated again upon a predetermined key enter from the keyboard.

The resultant output value fluctuates irregularly and slightly because of environmental vibrations and noises entering into cables, resulting a very poor S/N ratio at the bow pressure 0. In view of this, a threshold value is provided to set the output value to 0 when it is equal to or smaller than the threshold value. The output value in excess of the threshold value is used as it is.

The calculation of the bow pressure and string drawing point from the two strain values thus obtained, is performed in the following manner.

Figure 38:
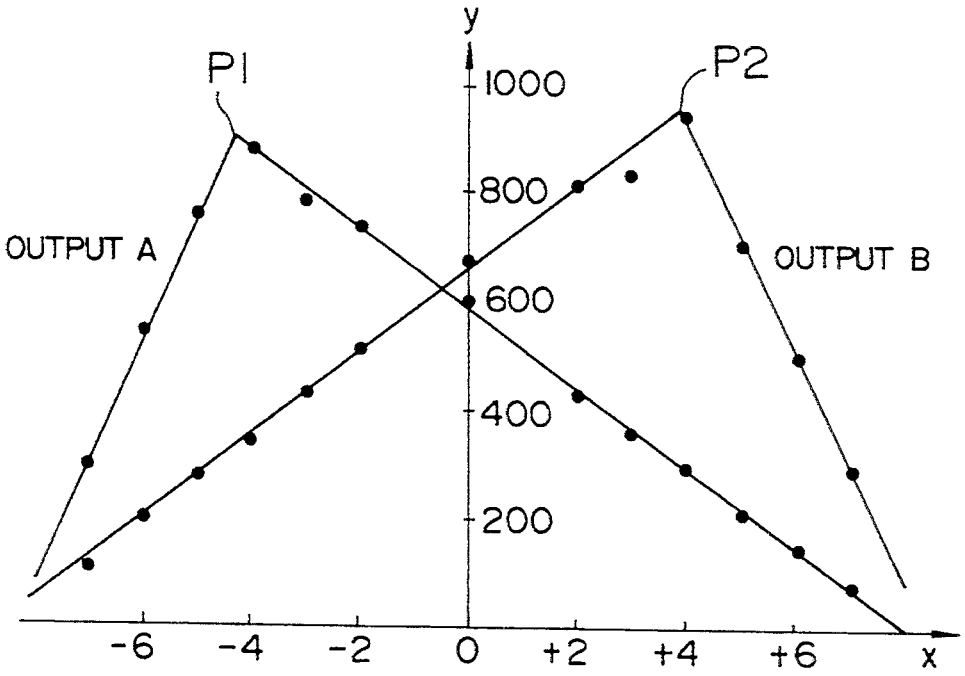
FIG. 38 is a diagram showing an example of outputs of the strain gauges of the embodiment shown in FIG. 23.

FIG. 38 shows the outputs A and B of the two strain gauges 39 relative to the position (string drawing position) at which a 150 gram-force is applied, for example, to the first string of the four string counterpart members 35. The x-axis represents the position (in cm unit) on the string with the bow pressure and speed sensors, the middle point is represented by 0, the fret side is given a positive sign +, and the neck side is given a negative sign −. The y-axis represents the output values.

For the different applied force, a graph generally proportional to that shown in FIG. 38 is obtained. The output values can therefore be approximated by broken lines. The positions of broken points P1 and P2 for each string counterpart member slightly differ depending upon an allowance of the mount positions of the strain gauges 39, a difference of the physical property of the sensor, a difference of the gain or the like of the strain gauge amplifier, and the like.

In this context, it is preferable to align the y-coordinates of the broken points by multiplying the output value by a scalar value through gain adjustment. In the example shown in FIG. 38, the gains were adjusted for the output A by a factor 900/900, and for the output B by a factor 900/960. Although it is also preferable to adjust the values in the x-axis direction, the values in the x-axis direction are not so much different for each string counterpart member and so the adjustment in the x-axis was omitted in this embodiment.

Figure 39:
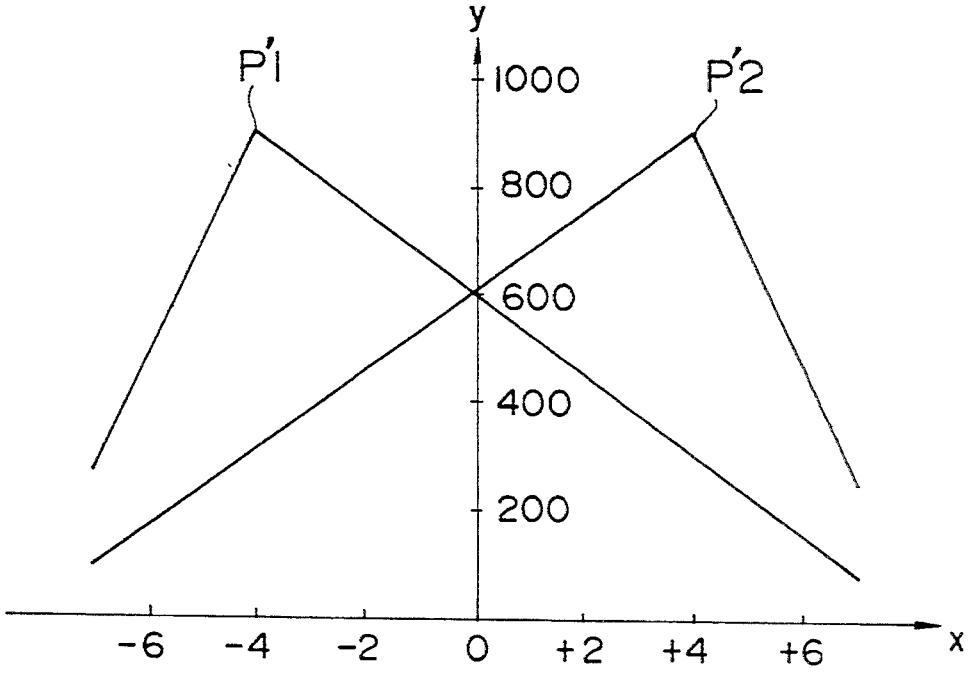
FIG. 39 is a diagram showing an example of outputs shown in FIG. 38 after compensation.

The results of the above-described adjustments are shown in FIG. 39. In FIG. 39, the x-coordinate of the broken point P'1 is +4 cm, and that of the broken point P'2 is −4 cm. Straight lines L1 to L4 can be given by the following equations:

$$L1: y = 210x + 1740$$

$$L2: y = -72.7x + 609$$

$$L3: y = 72.7x + 609$$

$$L4: y = -210x + 1740$$

Therefore, the output A/output B for the output A ≧ output B, i.e., for the string drawing point x ≦ 0, is given by:

$$(210x + 1740)/(72.7x + 609)\ (x \leqq -4)$$

$$(-72.7x + 609)/(72.7x + 609)\ (x \leqq 4)$$

For the output A < output B, the output A/output B can also be used.

Figure 40:
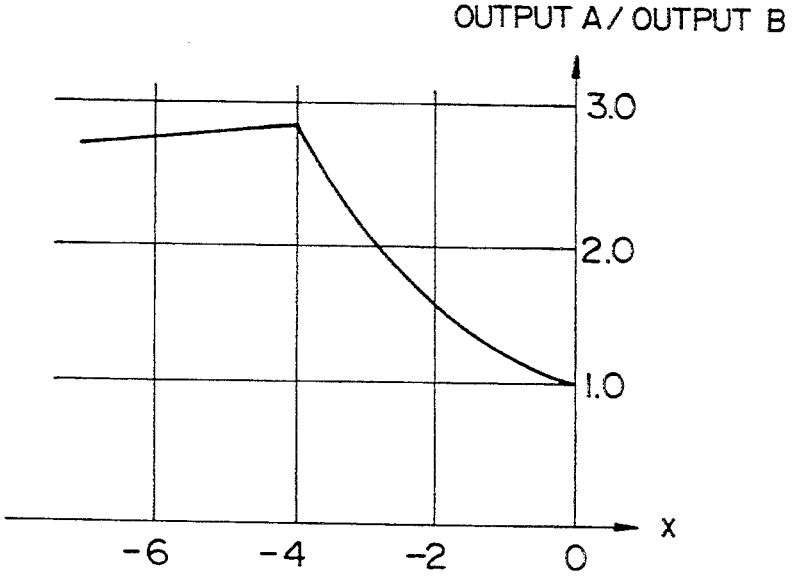
FIG. 40 is a diagram showing the output A/output B shown in FIG. 39 after compensation.

The output: A/output B for x ≦ 0 is shown in FIG. 40.

The inverse function of the output A/output B or output B/output A does not provide unanimous correspondence. Therefore, the position at the string drawing point in excess of +/−4 cm cannot be obtained from the output value ratio. In order to solve this problem, it is conceivable that the positions the strain gauges 39 are attached be set to opposite ends of the string. In this embodiment, the positions of the strain gauges 39 are not at opposite ends of the string as shown in FIG. 28 and it is assumed that the pressure is not applied to the positions in excess of +/−4 cm. In this case, the inverse transformation is given by:

$$x = 8.38x\ (1 \sim y)/(1 + y)$$

where y represents the gain, and x represents the string drawing point (distance from the center of the string).

The bow pressure value is given by:

$$609*Ha/(-72.7x+609)$$

$$609*Hb/(72.7x+609)$$

where the output A is Ha and the output B is Hb.

Although both the values are ideally the same, they are different in practice because of the influence of errors. Therefore, an average value of two values is used.

The value representing the string drawing point is passed through a simple low-pass filter so as not to present too rapid change.

Bow speed calculating means 48:

An input signal to the bow speed calculating means 48 is a signal obtained by analog processing friction sounds picked up by the microphone 36 at the analog processor 40.

This input signal also fluctuates more or less irregularly. Therefore, a threshold value is provided as in the case of the bow pressure and string drawing point calculating means 47.

Thereafter, the inverse conversion of the broken line compression is carried out.

The method of calculating the bow speed from the input signal is the same as the first embodiment. In this embodiment, however, it is not necessary to calculate the bow pressure, and so the low-pass filter 17 shown in FIG. 11 can be dispensed with.

String length calculating means 46:

An input signal to the string length calculating means 46 is an output per se from the finger pressing position detector shown in FIG. 27. Using the input value, the finger pressing position (distance in cm from the neck upper end) is first obtained, and then a real number key code is obtained from the finger pressing position.

Considering in advance the variation of the resistance values of the ribbon type variable registers 38 and the inverse proportional relationship between the finger pressing position and obtained resistance value, a correspondence table between the finger pressing positions and input values is formed in advance so that the finger pressing position can be obtained from the input value using the table. This corresponding table contains the data for the four string counterpart 41 members, with input values for finger pressing positions at an interval of 5 cm being stored in the table.

Conversion from the finger pressing position to a real number key code is given by the following logarithmic calculation which is also realized in the form of table:

$$KC=12*\log_2[StrLen/(StrLen-pos)]+OpenKC$$

where KC is a real number key code, StrLen is the length of an open string, pos is a finger pressing position, and OpenKC is a key code of the open string.

As described so far, tone control signals obtained by the bow pressure and string drawing point calculating means 47, bow speed calculating means 48, and string length calculating means 46 are subjected to the processes shown in FIG. 37, and sent to the tone signal synthesizer 33. The bow pressure value 0 is not sent to the synthesizer 33. The tone signal synthesizer 33 produces a sound in accordance with the inputted tone control signal.

Although the present invention has been described connection with the preferred embodiments, the present invention is not intended to be limited only to those embodiments. For example, it is apparent that various changes, improvements, combinations and the like can be made by those skilled in the art.

I claim:

1. A tone controller comprising:

a string counterpart member;

a bow for rubbing said string counterpart member to generate a friction sound;

friction sound detecting means for detecting said friction sound generated by rubbing together said bow and said string counterpart member and producing an output signal indicative of said detected friction sound; and signal processing means for generating a tone control signal from said output signal of said friction sound detecting means.

2. A tone controller according to claim 1, wherein said signal processing means includes a plurality of filters each having a different pass-band, wherein said output signal indicative of said detected friction sound is input to said plurality of filters to generate said tone control signal.

3. A tone controller according to claim 1, wherein said signal processing means includes a plurality of filters each including an adjustable pass-band, and means for setting the pass-band of each said plurality of filters.

4. A tone controller according to claim 1, wherein said friction sound detecting means detects a friction sound generated by rubbing said bow together with a material body simulating a string in a natural musical instrument.

5. A tone controller according to claim 4, wherein said signal processing means includes means for detecting a direction of rubbing based upon a change with time of a detected friction sound, and means for adding a sign to said detected friction sound in accordance with said detected direction.

6. A tone controller according to claim 1, wherein said friction sound detection means includes a microphone.

7. A tone controller comprising;

a string counterpart member;

a bow for rubbing said string counterpart member to generate a friction sound;

friction sound detecting means for detecting said friction sound generated by rubbing together said bow and said string counterpart member and producing an output signal indicative of said detected friction sound; and signal processing means for generating a tone control signal representing a bow pressure and a bow speed from said output signal of said friction sound detecting means.

8. A tone controller according to claim 7, further including a tone signal synthesizer for receiving said tone control signal and generating a musical tone.

9. A tone controller according to claim 7, wherein said signal processing means includes a plurality of filters each having a different pass-band, said output signal being input to said plurality of filters to generate said tone control signal.

10. A tone controller according to claim 7, wherein said signal processing means includes a plurality of filters each including an adjustable pass band, and means for setting the pass-band of each said plurality of filters.

11. A tone controller according to claim 7, wherein said friction sound detecting means detects a friction sound generated by rubbing said bow together with a material body simulating a string in a natural musical instrument.

12. A tone controller according to claim 11, wherein said signal processing means includes means for detecting a direction of rubbing based upon a change with time of said detected friction sound, and means for adding a sign to said detected friction sound in accordance with said detected direction.

13. A tone controller according to claim 7, wherein said friction sound detection means includes a microphone.

14. A tone controller comprising;

a string counterpart member;

a bow for rubbing said string counterpart member to generate a friction sound;

friction sound detecting means for detecting a friction sound generated by rubbing together said bow and said string counterpart member and producing an output signal indicative of said detected friction sound;

strain detecting means for detecting a strain in said string counterpart member caused by pressure of said bow on said string counterpart member and producing an output signal indicative of said detected strain; and signal processing means for generating a bow speed tone control signal from said output signal of said friction sound detecting means, and generating a bow pressure tone control signal from said output signal indicative of said detected strain.

15. A tone controller according to claim 14, wherein said friction sound detecting means detects a friction sound generated by rubbing said bow together with a material body simulating a string of a natural musical instrument.

16. A tone controller according to claim 14, wherein said signal processing means generates a tone control signal representing a string drawing point from an output of said strain detecting means.

17. A tone controller according to claim 14, further including a finger board, and finger pressing position detecting means for detecting a position of a finger in contact with said finger board.

18. A tone controller according to claim 14, wherein said friction sound detection means includes a microphone.

* * * * *